US007271784B2

(12) United States Patent
Koyama

(10) Patent No.: US 7,271,784 B2
(45) Date of Patent: Sep. 18, 2007

(54) DISPLAY DEVICE AND DRIVING METHOD THEREOF

(75) Inventor: Jun Koyama, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 498 days.

(21) Appl. No.: 10/731,442

(22) Filed: Dec. 10, 2003

(65) Prior Publication Data

US 2004/0207578 A1 Oct. 21, 2004

(30) Foreign Application Priority Data

Dec. 18, 2002 (JP) ..... 2002-366522

(51) Int. Cl.
*G09G 3/30* (2006.01)

(52) U.S. Cl. ..... 345/76; 345/82

(58) Field of Classification Search ..... 345/76, 345/77, 79, 80, 82, 83, 87–100, 78, 589, 345/590; 315/169.1, 169.3, 169.4; 348/800; 430/139

See application file for complete search history.

(56) References Cited

U.S. PATENT DOCUMENTS

| | | | | |
|---|---|---|---|---|
| 4,481,511 | A | 11/1984 | Hanmura et al. | |
| 4,930,874 | A * | 6/1990 | Mitsumune et al. | 349/48 |
| 5,734,450 | A * | 3/1998 | Irie et al. | 349/39 |
| 5,805,128 | A | 9/1998 | Kim et al. | |
| 5,844,368 | A | 12/1998 | Okuda et al. | |
| 5,999,154 | A | 12/1999 | Yoshioka | |
| 6,219,022 | B1 | 4/2001 | Yamazaki et al. | |
| 6,246,399 | B1 | 6/2001 | Yamane et al. | |
| 6,501,466 | B1 | 12/2002 | Yamagishi et al. | |
| 6,518,941 | B1 * | 2/2003 | Kimura | 345/55 |
| 6,528,950 | B2 | 3/2003 | Kimura | |
| 6,545,655 | B1 | 4/2003 | Fujikawa | |
| 6,548,960 | B2 | 4/2003 | Inukai | |
| 6,611,261 | B1 | 8/2003 | Zhang et al. | |
| 6,693,388 | B2 * | 2/2004 | Oomura | 315/169.3 |
| 6,710,549 | B2 | 3/2004 | Okada et al. | |
| 6,774,574 | B1 | 8/2004 | Koyama | |
| 6,777,887 | B2 | 8/2004 | Koyama | |

(Continued)

FOREIGN PATENT DOCUMENTS

| | | |
|---|---|---|
| EP | 1 063 360 | 12/2000 |

(Continued)

OTHER PUBLICATIONS

International Search Report dated Mar. 23, 2004 and International Preliminary Examination Report dated Apr. 20, 2004 (Application No. PCT/JP03/16026) (Partial Translation).

*Primary Examiner*—Nitin I. Patel
(74) *Attorney, Agent, or Firm*—Fish & Richardson P.C.

(57) ABSTRACT

The present invention comprises pixels each configured by a switching element and a light-emitting element, and a plurality of source signal lines for one pixel column. An input terminal of the switching element is connected to any one of the plurality of source signal lines and an output terminal of the switching element is connected to the light-emitting element so as to enable a light emission when the switching element is turned ON. Pixels in plurality of rows emit light simultaneously, so that a longer light emission time can be realized. It can make the lifetime of an element longer and the power consumption lower.

44 Claims, 19 Drawing Sheets

U.S. PATENT DOCUMENTS

| | | | | |
|---|---|---|---|---|
| 6,930,447 | B2 | 8/2005 | Kim | |
| 6,933,756 | B2 * | 8/2005 | Miyazawa | 327/112 |
| 6,963,336 | B2 | 11/2005 | Kimura | |
| 7,071,911 | B2 | 7/2006 | Inukai | |
| 2001/0035863 | A1 | 11/2001 | Kimura | |
| 2001/0048408 | A1 | 12/2001 | Koyama et al. | |
| 2002/0044124 | A1 | 4/2002 | Yamazaki et al. | |
| 2002/0047568 | A1 | 4/2002 | Koyama | |
| 2002/0153844 | A1 | 10/2002 | Koyama | |
| 2003/0006997 | A1 | 1/2003 | Ogawa et al. | |
| 2003/0128199 | A1 | 7/2003 | Kimura | |
| 2003/0156102 | A1 | 8/2003 | Kimura | |
| 2003/0169250 | A1 | 9/2003 | Kimura | |
| 2003/0193298 | A1 | 10/2003 | Okada et al. | |
| 2004/0085029 | A1 | 5/2004 | Kimura | |
| 2004/0207331 | A1 | 10/2004 | Koyama | |

FOREIGN PATENT DOCUMENTS

| | | | |
|---|---|---|---|
| EP | 1 063 630 | A2 | 12/2000 |
| EP | 1 128 355 | A2 | 8/2001 |
| EP | 1 349 138 | A2 | 10/2003 |
| JP | 52-019960 | | 5/1977 |
| JP | 57-114189 | | 7/1982 |
| JP | 58-132791 | | 8/1983 |
| JP | 09-232074 | | 9/1997 |
| JP | 11-102172 | | 4/1999 |
| JP | 2001-005426 | | 1/2001 |
| JP | 2001-034237 | | 2/2001 |
| JP | 2001-147659 | | 5/2001 |
| JP | 2001-312243 | | 11/2001 |
| JP | 2002-108285 | | 4/2002 |
| JP | 2002-196721 | | 7/2002 |
| JP | 2002-214645 | | 7/2002 |
| JP | 2004-077567 | * | 8/2002 |
| JP | 2002-278478 | | 9/2002 |
| JP | 2003-087562 | | 3/2003 |
| JP | 2003-280586 | | 10/2003 |

* cited by examiner

DISPLAY DEVICE AND DRIVING METHOD THEREOF

TECHNICAL FIELD

The present invention relates to a display device, and more particularly to a display device in which an electroluminescence (hereinafter, abbreviated as EL) element is used as a light-emitting medium.

BACKGROUND ART

In recent years, with the advance of the communication technology, mobile phones have been widely used. In future, transmission of moving images and a larger volume of information are expected. On the other hand, through reduction in weight of personal computers, mobile personal computers have been produced. Information terminals called PDA originated in electronic notebooks have also been produced in large quantities and widely used. In addition, with the development of display devices, the majority of such portable information equipment are equipped with a flat panel display.

Recently among flat panel displays, manufactured for productization has been a display device having a thin film transistor (hereinafter, referred to as TFT) using a polycrystalline semiconductor crystallized at a temperature of 600° C. or less, which is rather low as compared to the conventional condition of 1000° C. or more. By the TFT using a polycrystalline semiconductor crystallized at a low temperature, not only a pixel but also a signal line driver circuit can be integrally formed around a pixel portion, which makes it possible to realize downsizing and high definition of a display device. Thus, such a display device is expected to be more widely used in future.

As for the display device having a TFT using a polycrystalline semiconductor crystallized at a low temperature, a display device in which a light-emitting element, particularly an organic EL element, is used as well as a liquid crystal display device has been developed. In addition, as for the display device in which an organic EL element is used, a passive matrix display device has been developed and produced for display devices of mobile phones, car stereos, and the like.

FIG. 2 schematically shows a conventional passive matrix display device. The display device shown in FIG. 2 has a pixel portion arranged in the center of a substrate 201 made of glass or the like. The pixel portion has light-emitting elements, column signal lines, and row signal lines arranged therein. A column signal line driver circuit 202 for controlling the column signal lines is disposed on the upper side of the substrate 201. On the left side of the substrate 201, a row signal line driver circuit 203 for controlling the row signal lines is disposed. Furthermore, a controller 240 is disposed for controlling the column signal line driver circuit 202 and the row signal line driver circuit 203. Note that the column signal line driver circuit 202 and the row signal line driver circuit 203 are each composed of LSI chips, and connected to the substrate 201 through a FPC (flexible Printed Circuit) (e.g., see Patent Document 1).

(Patent Document 1) Japanese Patent Application Laid-Open No. Hei 9-232074

Referring to FIG. 2, operation of a passive matrix display device is described. First, a row signal line 220 in the first row is selected. A state of being selected here means that a switch 212 is connected to GND. Next, switches 208 to 211 of the column driver are turned ON. One end of each of the switches 208 to 211 is connected to constant current sources 204 to 207 respectively, and the other end thereof is connected to column signal lines 216 to 219 respectively. When the switches 208 to 211 are turned ON, currents output from the constant current sources 204 to 207 flow into light-emitting elements 224 to 227 via the switches 208 to 211 and the column signal lines 216 to 219. Then, passing through the light-emitting elements 224 to 227, the currents further pass through the switch 212 via the row signal line 220, and flow into GND. In this way, the light-emitting elements 224 to 227 emit light in response to the flow of current therethrough. Periods in which the switches 208 to 211 are turned ON vary from one another. Gray scale display is thus performed based on the length of periods in which the switches are turned ON. After the switches 208 to 211 are all turned OFF, the switch 212 of the row signal line driver circuit is connected to VCC. Then, a switch 213 is connected to GND, and this operation will be repeated. In the case where a switch of the row signal line driver circuit is connected to VCC, a reverse bias is applied to light-emitting elements of the row, so that no current flows, and no light is emitted.

The luminance of light-emitting elements 224 to 239, that is, the amount of current flowing in the light-emitting elements 224 to 239 can be respectively controlled by the current value of the constant current sources 204 to 207 of the column signal line driver circuit and the length of period in which the switches 208 to 211 are turned ON. FIG. 3 shows an example of the column signal line driver circuit. A constant voltage is generated first with a built-in constant voltage source 301. As the constant voltage source, a known band gap regulator or the like is frequently used. In addition, a power source with a small temperature coefficient is used. The generated constant voltage is converted into a current by an operational amplifier 302, a transistor 303, and a resister 304. Thus, a constant current with a small temperature coefficient can be generated. The current is reversed and duplicated to obtain plural currents by a current mirror circuit composed of transistors 305 to 309 and resisters 314 to 318 before being supplied to the column signal lines via switches 310 to 313.

A method for gray scale display of a light-emitting element is described hereinafter. In the column signal line driver circuit shown in FIG. 2, when there is no variation in the length of ON periods among the switches 208 to 211, only two gray scales can be obtained in this display device. An expression method of the gray scale in this display device is described with reference to FIG. 4.

A timing chart of a time gray scale method is simply illustrated in FIG. 4. In this example, a frame frequency is set at 60 Hz, and 3-bit gray scale is obtained according to the time gray scale method. When the frame frequency is 60 Hz, one frame period is 16.6 ms. The value obtained by dividing this frame period by the number of pixels in the perpendicular direction approximately equals one horizontal line period 401. In the case where the number of pixels in the perpendicular direction is 220, for example, one horizontal line period is 75 μs. In the above-mentioned method, when 90% of this horizontal line period is an image period (a period in which an image signal exists), the image period is 68 μs. In the case of performing 3-bit gray scale display, that is, display in 8 gray scales in this image period, the length of ON period of the switch, namely a lighting period 402 may be set in proportion to gray scales, as illustrated in FIG. 4. In FIG. 4, a period denoted by reference numeral 403 is a non-lighting period and a period denoted by reference numeral 404 is a blanking period.

In the time gray scale method, the gray scale can be expressed in the above-described manner. It is of course possible to express the same kind of gray scale in a color display device.

FIG. 5 shows an active matrix display device. Pixels of the active matrix display device in FIG. 5 are configured by switching TFTs 508 to 511, EL driving TFTs 512 to 515, storage capacitors 516 to 519, and EL elements 520 to 523. Operation thereof is described below.

When a gate signal line 505 connected to a gate signal line driver circuit 502 becomes high, the switching TFTs 508 and 510 are turned ON and image signals supplied from source signal lines 503 and 504 connected to a source signal line driver circuit 501 are input to the storage capacitors 516 and 518 and the gates of the EL driving TFTs 512 and 514. Then, by the driving TFTs 512 and 514, the amount of current according to the voltage value flows from a power source line 507 into the EL elements 520 and 522. The EL driving TFTs 512 and 514 serve as voltage-to-current converting elements here. When the gate signal line 505 becomes low, the switching TFTs 508 and 510 are turned OFF. However, charge is held in the storage capacitors 516 and 518 so that the EL driving TFTs 512 and 514 maintain the same state to keep supplying current to the EL elements 520 and 522. As above, an active matrix display device comprises pixels having memory performance, therefore light emission at the same state can be continued until next writing starts.

When a gate signal line 506 becomes high, the switching TFTs 509 and 511 are turned ON and image signals of the source signal lines are input to the gates of the EL driving TFTs 513 and 515 and the storage capacitors 517 and 519. Current flows into the EL elements 521 and 523 by the EL driving TFTs 513 and 515, so that the EL elements 521 and 523 emit light. (The above description is, for example, disclosed in Patent Document 2.)

(Patent Document 2) Japanese Patent Application Laid-Open No. 2002-108285

Among active matrix display devices, a display device using a current mirror circuit as shown in FIG. 6 has been also developed. This display device comprises pixels provided with current mirror circuits which are configured by TFTs 609 and 610, TFTs 611 and 612, TFTs 613 and 614, and TFTs 615 and 616. A luminance signal is supplied not with voltage but with current from a source signal line driver circuit 601 to source signal lines 603 and 604, and gate signal lines 605 and 606 are controlled by a gate signal line driver circuit 602. When switches 621 to 628 are turned ON, the current mirror circuits operate so that the amount of current according to an output current of the source signal line driver circuit flows into EL elements 629 to 632. Even when the gate signal line driver circuit turns OFF the switches, the TFTs 610, 612, 614, and 616 operate to keep supplying current to the EL elements 629 to 632 in the case where charge is accumulated in capacitors 617 to 620 (e.g., see Patent Document 3).

(Patent Document 3) Japanese Patent Application Laid-Open No. 2001-147659

The aforementioned conventional organic EL display device has the following problems. First, as for a passive matrix organic EL display device, there is a problem in that the number of pixels can not be increased much. A passive matrix EL display device comprises pixels having no holding function, therefore light emission can be held only momentarily. The value obtained by dividing one frame period by the number of column lines equals a light emission period. The number of column lines is inevitably increased and the light emission period becomes shorter with the increase in the number of pixels. Generally, one frame period is approximately 16.6 ms in view of a flicker, and in the case where pixels are equal to 176×RGB×220, a lighting time of one line is 75 μs. When the light emission period is short while lighting luminance is high like the above, a large amount of current is required to be supplied to an organic EL element of a pixel, leading the short life of the organic EL element and the increase in power consumption due to the increase in forward voltage. Since a lighting period of a practical passive matrix display device is frequently set at 250 μs or more, it is difficult to increase the number of pixels in the passive matrix EL display device.

On the other hand, an active matrix organic EL display device as shown in FIG. 5 comprises pixels having memory function, therefore an organic EL element of a pixel can keep lighting during one frame period. The problem such as a passive matrix display device does not occur. However, in the aforementioned active matrix display device, voltage held in a capacitor is converted into current by a TFT in the pixel, so that variations in characteristics of TFTs affect the converted current. Low temperature polysilicon TFT is formed through crystallization using linear laser light, therefore due to the variations, characteristics of the TFTs vary in striped shape. Consequently, there is a problem in that variations in luminance arise in striped shape.

In the case of the display device using a current mirror circuit as shown in FIG. 6, the aforementioned variations in luminance can be prevented when there is no variations in characteristics of a pair of TFTs 609 and 610 which configures the current mirror. Uniform characteristics of the TFTs 609 and 610 can be realized by increasing each TFT size. However, TFTs occupies larger areas in a pixel and the opening ratio is decreased in such display devices, which leaves a problem in that such display device using a current mirror circuit is not applicable to a small pixel.

DISCLOSURE OF THE INVENTION

In order to solve the above-mentioned problems, a pixel is configured by one or more thin film transistors and a light-emitting element, and pixels in a plurality of rows are lighted simultaneously according to the present inventing. As a result of this, problems of a conventional display device such as a short light emission period, display variations due to variations in pixel TFTs, and decrease in opening ratio can be eliminated.

One feature of the present invention is to provide a display device comprising a substrate on which a plurality of pixels each configured by a switching element and a light-emitting element are disposed in matrix, and wherein a plurality of source signal lines is disposed for one pixel column and one gate signal line is disposed for one pixel row. The switching element has an input terminal, an output terminal, and a control terminal. The input terminal is electrically connected to any one of the plurality of source signal lines, the output terminal is electrically connected to the light-emitting element, and the control terminal is electrically connected to the gate signal line. The switching element can be configured by one thin film transistor. Furthermore, the switching element can be configured by a multi-gate thin film transistor such as a double-gate thin film transistor and a triple-gate thin film transistor. In addition, an EL element can be employed as the light-emitting element.

One feature of the present invention is to provide a display device comprising a substrate on which a plurality of pixels each configured by a switching element and a light-emitting element are disposed in matrix, and wherein a plurality of source signal lines is disposed for one pixel column, one gate signal line is disposed for one pixel row. The switching element has an input terminal, an output terminal, and a control terminal. The input terminal is electrically connected to any one of the plurality of source signal lines, the output terminal is electrically connected to the light-emitting element, and the control terminal is electrically connected to the gate signal line. The display device also comprises a plurality of source signal line driver circuits each electrically connected to at least one of the plurality of source signal lines. Each of the source signal line driver circuits is a current output type source signal line driver circuit and may be configured by a thin film transistor. The source signal line driver circuits and the switching element can be formed on the same substrate. A semiconductor chip may be mounted as the source signal line driver circuit. The plurality of source signal line driver circuits may be divided to be disposed on both sides of a region disposing the plurality of pixels (up and down or right and left side of the region). Further, the source signal line driver circuit drives any one of the plurality of source signal lines. The switching element can be configured by one thin film transistor. Furthermore, the switching element can be configured by a multi-gate thin film transistor such as a double-gate thin film transistor and a triple-gate thin film transistor. In addition, an EL element can be employed as the light-emitting element.

One feature of the present invention is to provide a display device comprising a substrate on which a plurality of pixels each configured by a switching element and a light-emitting element are disposed in matrix, and wherein a plurality of source signal lines is disposed for one pixel column, one gate signal line is disposed for one pixel row. The switching element has an input terminal, an output terminal, and a control terminal. The input terminal is electrically connected to any one of the plurality of source signal lines, the output terminal is electrically connected to the light-emitting element, and the control terminal is electrically connected to the gate signal line. The display device also comprises one gate signal line driver circuit which drives a plurality of the gate signal lines simultaneously. The gate signal line driver circuit may be configured by a thin film transistor. The gate signal line driver circuit and the switching element can be formed on the same substrate. A semiconductor chip may be mounted as the gate signal line driver circuit. The switching element can be configured by one thin film transistor. Furthermore, the switching element can be configured by a multi-gate thin film transistor such as a double-gate thin film transistor and a triple-gate thin film transistor. In addition, an EL element can be employed as the light-emitting element.

In the aforementioned present invention, the source signal line driver circuit or the gate signal line driver circuit can be configured by using a transistor having single polarity.

One feature of the present invention is to provide a driving method of a display device comprising a substrate on which a pixel each configured by a switching element and a light emitting element are disposed in matrix, and wherein a plurality of source signal lines is disposed for one pixel column, and one gate signal line is disposed for one pixel row. The switching element has an input terminal, an output terminal, and a control terminal. The input terminal is electrically connected to any one of the plurality of source signal lines, the output terminal is electrically connected to the light-emitting element, and the control terminal is electrically connected to the gate signal line. In the driving method, a plurality of the gate signal lines is simultaneously driven to turn ON a plurality of the switching elements so that a signal of any one of the plurality of source signal lines is input to the light-emitting element to be driven. A switching element can be configured by one thin film transistor or a multi-gate thin film transistor in this driving method of the light-emitting element.

BEST MODE FOR CARRYING OUT THE INVENTION

An embodiment mode of the present invention is described with reference to drawings hereinafter.

Figure 1:
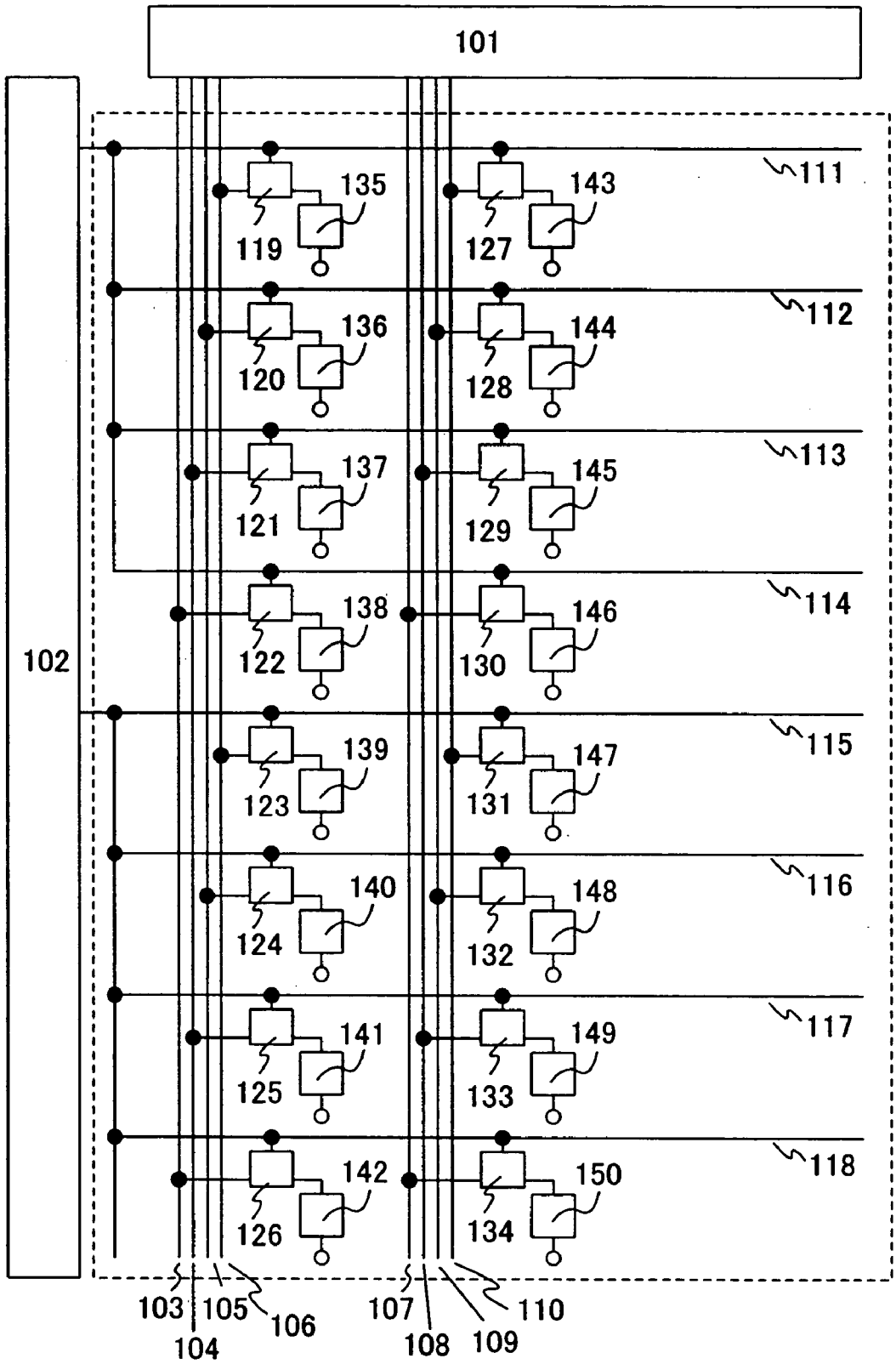
FIG. 1 is a diagram showing an embodiment mode of the present invention.
Figure 2:
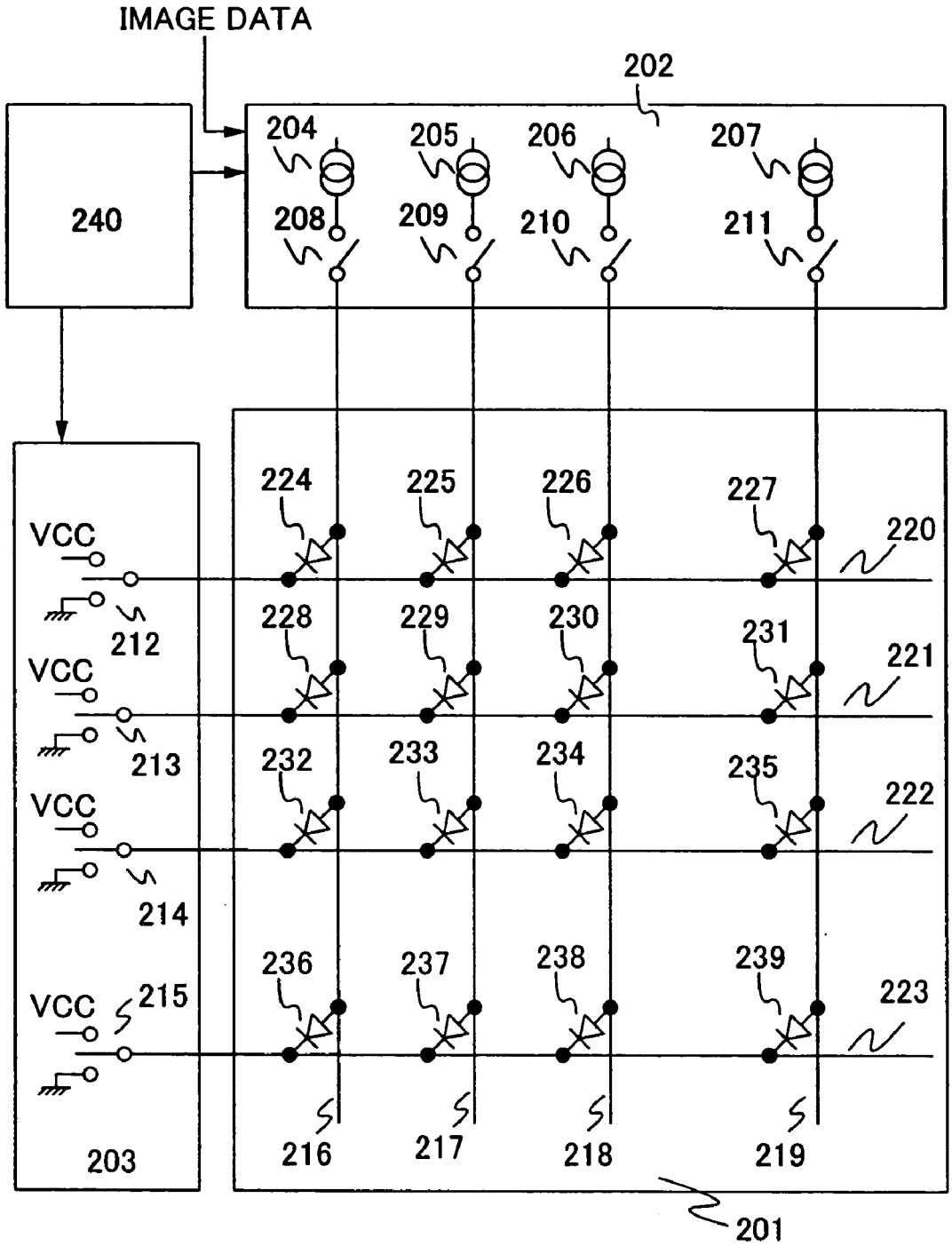
FIG. 2 is a diagram showing a conventional passive matrix EL display device.

FIG. 1 schematically shows a display device of the present invention. One pixel is configured by one switching element and one light-emitting element in FIG. 1. Four source signal lines are disposed for one pixel column and one gate signal line is disposed for one pixel row. The number of the source signal lines disposed for one pixel column is four in this embodiment mode, however, it is not limited to four.

Each of source signal lines 103 to 110 connected to a source signal line driver circuit 101 is connected to an input terminal of a switching element, one electrode of a light-emitting element is connected to an output terminal of the switching element, a gate signal line connected to a gate signal line driver circuit 102 is connected to a control terminal of the switching element. The source signal line driver circuit 101 used here is preferably the one shown in FIG. 3 in which current is output to a source signal line, however, it is not limited to this. When current is output from the source signal line driver circuit 101 and gate signal lines 111 to 114 become high (active), switching elements 119 to 122 and 127 to 130 are turned ON and current flows through the switching elements into light-emitting elements 135 to 138 and 143 to 146, and a common cathode, so that the light-emitting elements 135 to 138 and 143 to 146 emit light.

Subsequently, when the gate signal lines 111 to 114 become low, the switching elements 119 to 122 and 127 to 130 are turned OFF. Then when gate signal lines 115 to 118 become high, switching elements 123 to 126 and 131 to 134 are turned ON and current flows into light-emitting elements 139 to 142 and 147 to 150, so that they emit light. By repeating this, the whole screen emits light.

In the case of expressing a gray scale, the expression is achieved by controlling current flowing through a source signal line.

The present invention is different from a conventional passive matrix EL display device in that the plurality of gate signal lines 111 to 114 is turned ON simultaneously. In FIG. 1, the number of source signal lines for one column is four and four gate signal lines can be turned ON.

Therefore, in the case where the number of pixels is 176×RGB×220, a lighting period of one line is approximately 75 μs in the conventional passive matrix EL display device, whereas a lighting period of 300 μs is realized in the present invention since four lines can be lighted simultaneously. As a result of this, the reliability equivalent to a passive matrix EL display device having a small number of pixels can be obtained.

The source signal line driver circuit and the gate signal line driver circuit may be formed together with the switching element on the substrate, or alternatively, a driver circuit may be manufactured separately from the switching element and mounted on a pixel substrate. Monocrystalline silicon or non-monocrystalline such as poly-silicon and amorphous silicon may be used for the driver circuit.

In addition, since a switching element in each pixel only controls ON/OFF of current and does not perform voltage-to-current conversion, variations in luminance due to variations in switching elements do not arise. Furthermore, the discharge of charge due to off current of a switching element can be prevented. Therefore, deterioration of image quality due to variation in laser crystallization can be prevented while it arises in a conventional active matrix EL display device. Besides, one pixel comprises one switching element and there is thus no need of providing a complex circuit in each pixel. It is not necessary to increase the size of a switching element in order to reduce variations. Therefore, there is an advantage of no decrease in opening ratio and applicability to a small pixel.

As described above, problems such as a very short lighting period of an EL element as a passive matrix EL display device can be solved as well as variations in luminance in striped shape due to variations in elements and decrease in opening ratio as a conventional active matrix EL light-emitting device.

EMBODIMENT

Embodiment 1

Figure 13:
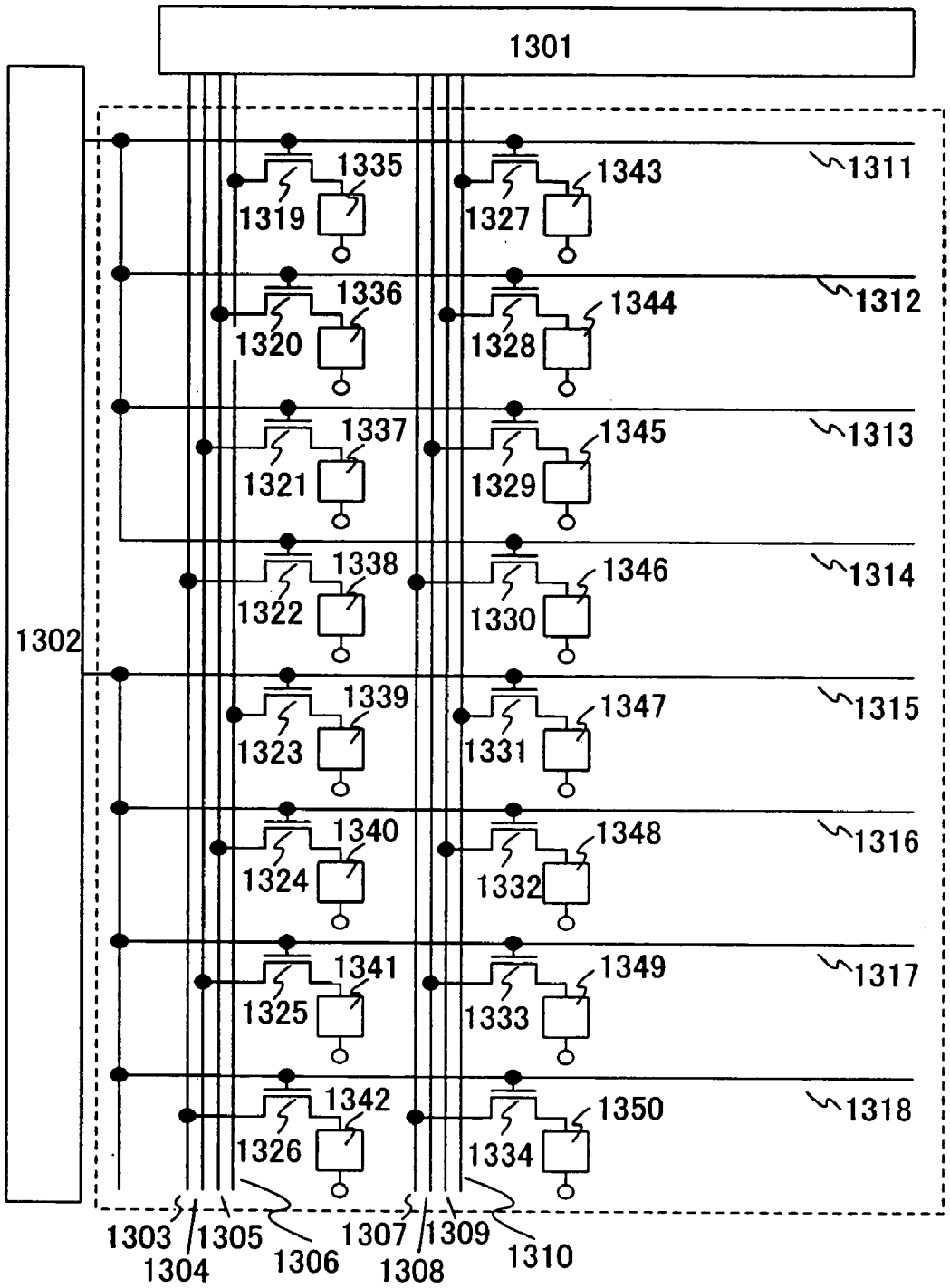
FIG. 13 is a diagram showing an embodiment in which a switching element of the present invention is configured by one TFT.

FIG. 13 schematically shows a display device of the present invention. One pixel is configured by one TFT and one light-emitting element in FIG. 13. A source signal line connected to a source signal line driver circuit 1301 is connected to either one of a source electrode or a drain electrode of a TFT, one electrode of a light-emitting element is connected to either the other of the source electrode or the drain electrode of the TFT, and a gate signal line connected to a gate signal line driver circuit 1302 is connected to a gate electrode of the TFT. The source signal line driver circuit 1301 used here is preferably the one shown in FIG. 3 in which current is output to a source signal line, however, it is not limited to this.

When current is output from the source signal line driver circuit 1301 to source signal lines 1303 to 1310 and gate signal lines 1311 to 1314 become high (in the case where a pixel TFT is an N-channel type), current flows into TFTs 1319 to 1322 and 1327 to 1330, and through these TFTs, the current flows into EL elements 1335 to 1338 and 1343 to 1346, and a common cathode, so that the EL elements 1335 to 1338 and 1343 to 1346 emit light.

Subsequently, when the gate signal lines 1311 to 1314 become low (in the case where a pixel TFT is an N-channel type), the TFTs 1319 to 1322 and 1327 to 1330 are turned OFF. Then when gate signal lines 1315 to 1318 become high, TFTs 1323 to 1326 and 1331 to 1334 are turned ON and current flows into EL elements 1339 to 1342 and 1347 to 1350, so that they emit light. By repeating this, the whole screen emits light. Described above is the case where a pixel TFT is an N-channel type, however, a potential of the gate signal line are reversed to this in the case where the pixel TFT is a P-channel type.

The source signal line driver circuit 1301 and the gate signal line driver circuit 1302 may be formed together with the pixel TFT on the substrate, or alternatively, a driver circuit may be manufactured separately from the pixel TFT and mounted on a pixel substrate. Monocrystalline silicon or non-monocrystalline such as poly-silicon and amorphous silicon may be used for the driver circuit.

Figure 4:
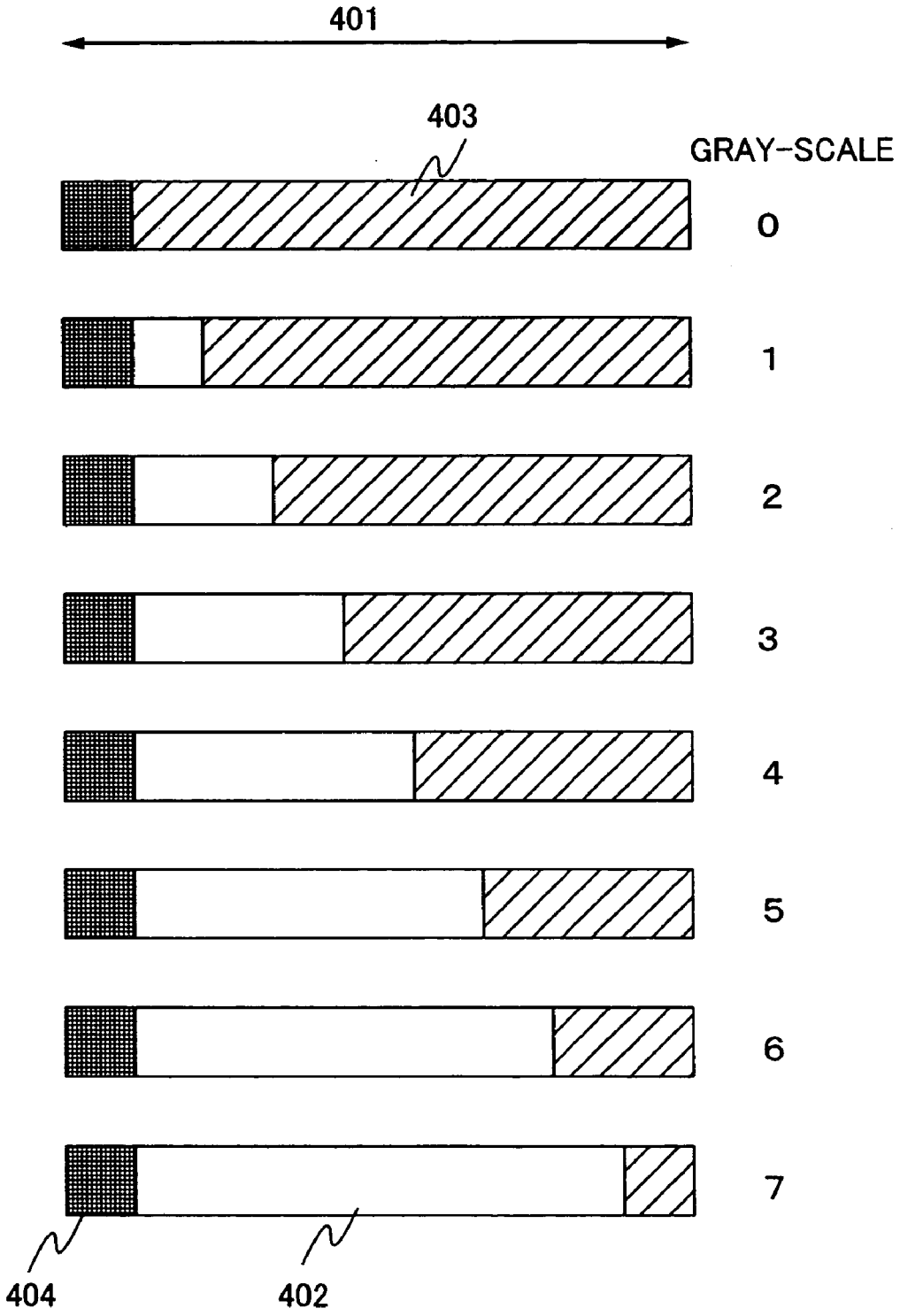
FIG. 4 is a diagram showing a gray scale in a conventional passive matrix EL display device.
Figure 5:
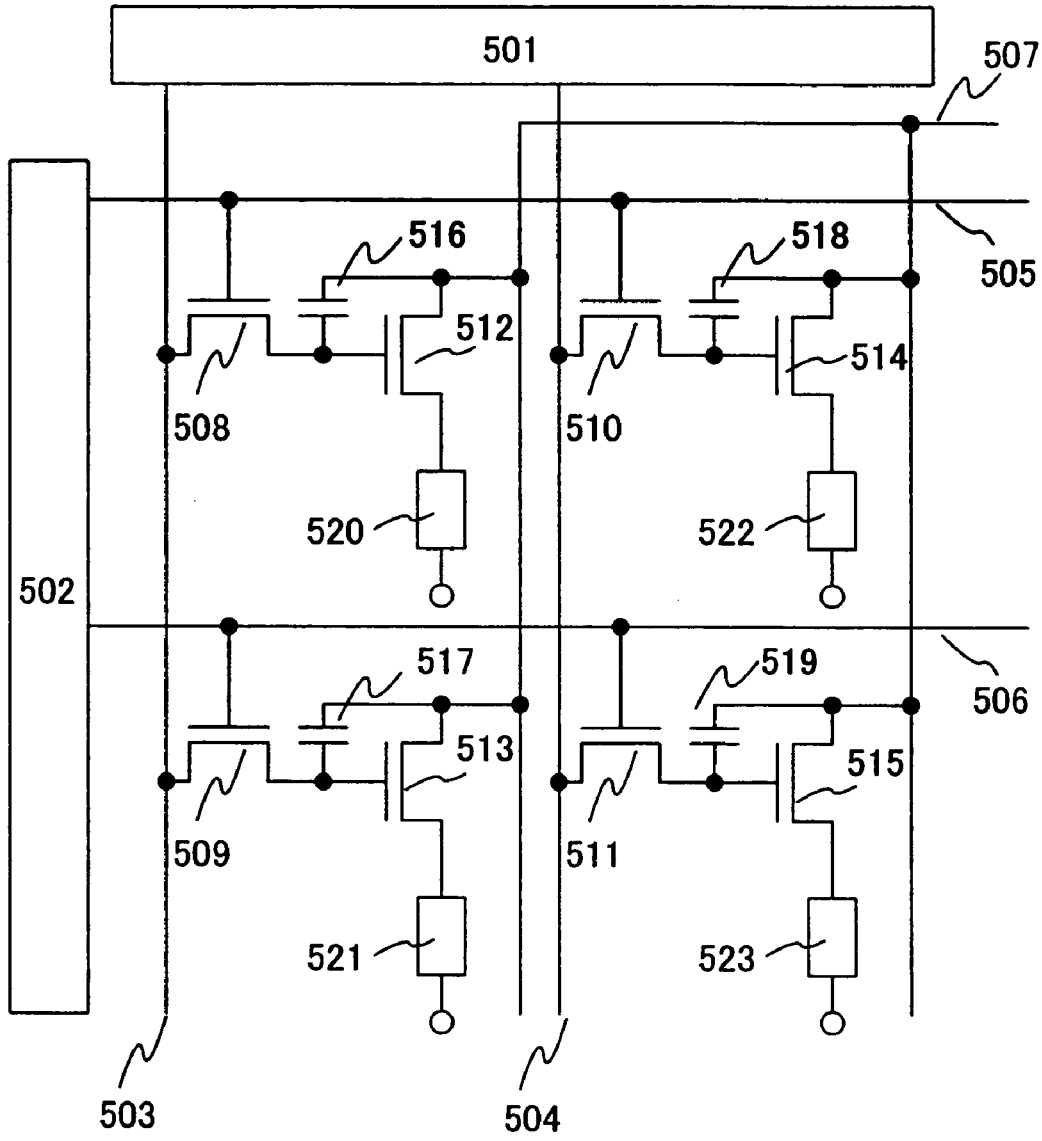
FIG. 5 is a diagram showing a pixel of a conventional active matrix EL display device.
Figure 6:
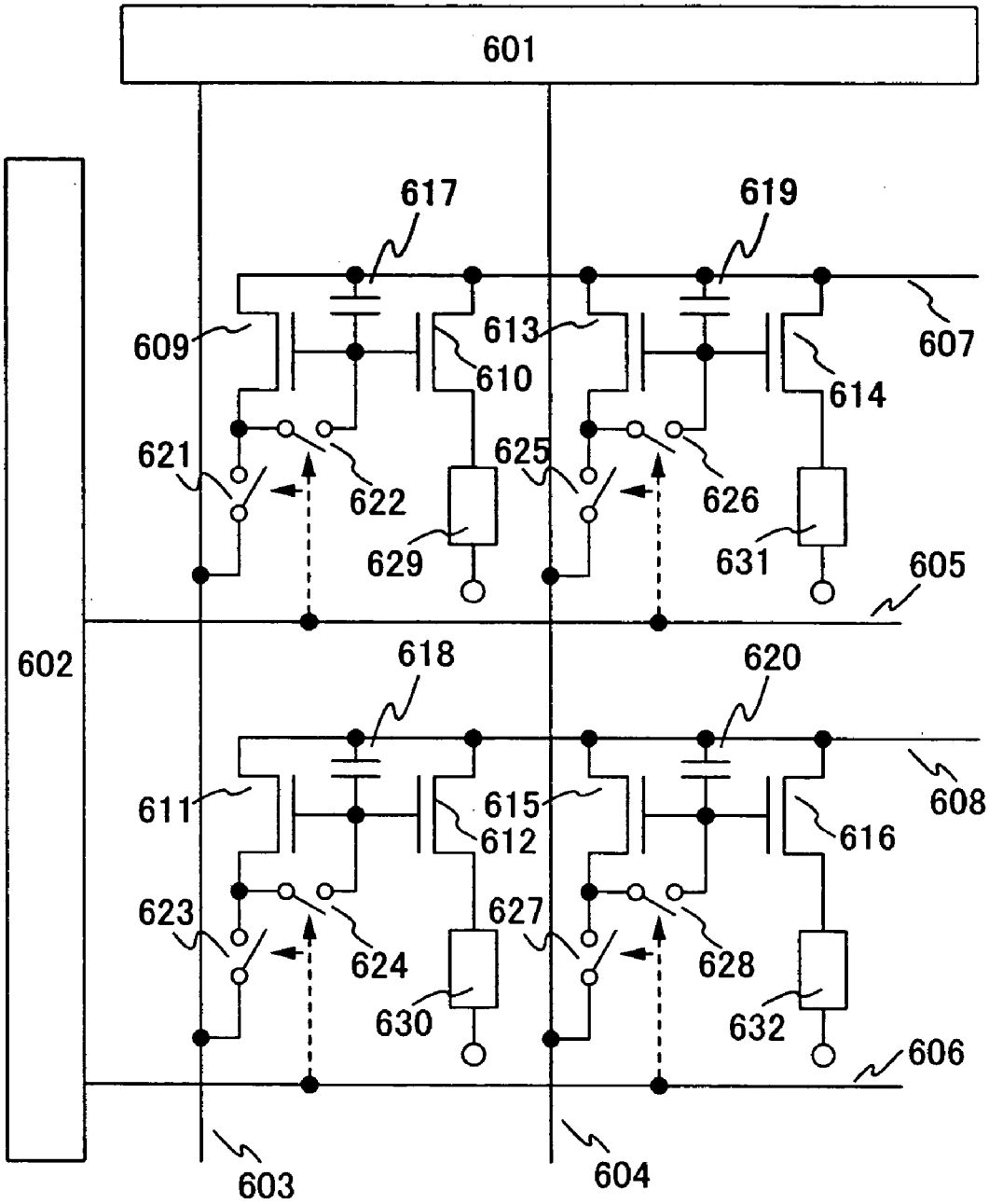
FIG. 6 is a diagram showing a pixel of a conventional active matrix EL display device using a current mirror.

In the case of expressing a gray scale, the expression is achieved by controlling current flowing through a source signal line as shown in FIG. 4.

Embodiment 2

Figure 14:
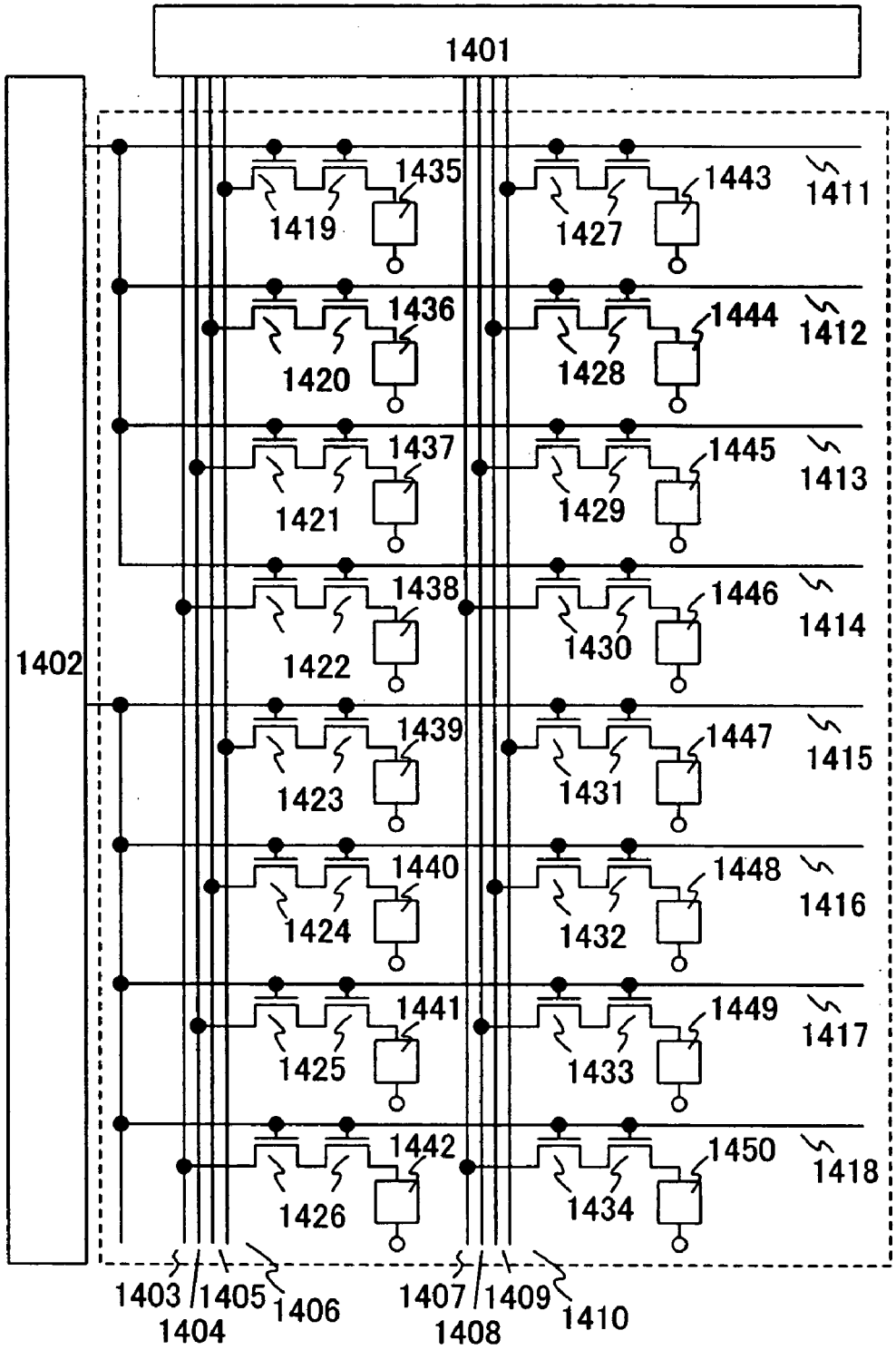
FIG. 14 is a diagram showing an embodiment in which a switching element of the present invention is configured by a plurality of TFTs.

FIG. 14 shows an example in which a switching element is configured by a double-gate TFT. By configuring a switching element by a plurality of TFTs like this, a drop in yield of a light-emitting device can be suppressed even in the case where the switching element has a large leak. The switching element is configured by a double-gate TFT in this embodiment, however, it is not limited to this in the present invention and may be a multi-gate TFT such as a triple-gate TFT or other configurations.

When current is output from a source signal line driver circuit 1401 to source signal lines 1403 to 1410 and gate signal lines 1411 to 1414 become high (in the case where a pixel TFT is an N-channel type), current flows into TFTs 1419 to 1422 and 1427 to 1430, and through these TFTs, the current flows into EL elements 1435 to 1438 and 1443 to 1446, and a common cathode, so that the EL elements 1435 to 1438 and 1443 to 1446 emit light.

Subsequently, when the gate signal lines 1411 to 1414 become low (in the case where a pixel TFT is an N-channel type), the TFTs 1419 to 1422 and 1427 to 1430 are turned OFF. Then when gate signal lines 1415 to 1418 become high, TFTs 1423 to 1426 and 1431 to 1434 are turned ON and current flows into EL elements 1439 to 1442 and 1447 to 1450, so that they emit light. By repeating this, the whole screen emits light. Described above is the case where a pixel TFT is an N-channel type, however, a potential of the gate signal line is reversed to this in the case where the pixel is a P-channel type.

The source signal line driver circuit 1401 and the gate signal line driver circuit 1402 may be formed together with the pixel TFT on the substrate, or alternatively, a driver circuit may be manufactured separately from the pixel TFT and mounted on a pixel substrate. Monocrystalline silicon or non-monocrystalline such as poly-silicon and amorphous silicon may be used for the driver circuit.

In the case of expressing a gray scale, the expression is achieved by controlling current flowing through a source signal line as shown in FIG. 4.

The switching element shown in this embodiment can be applied to other embodiments in this description.

Embodiment 3

Figure 16:
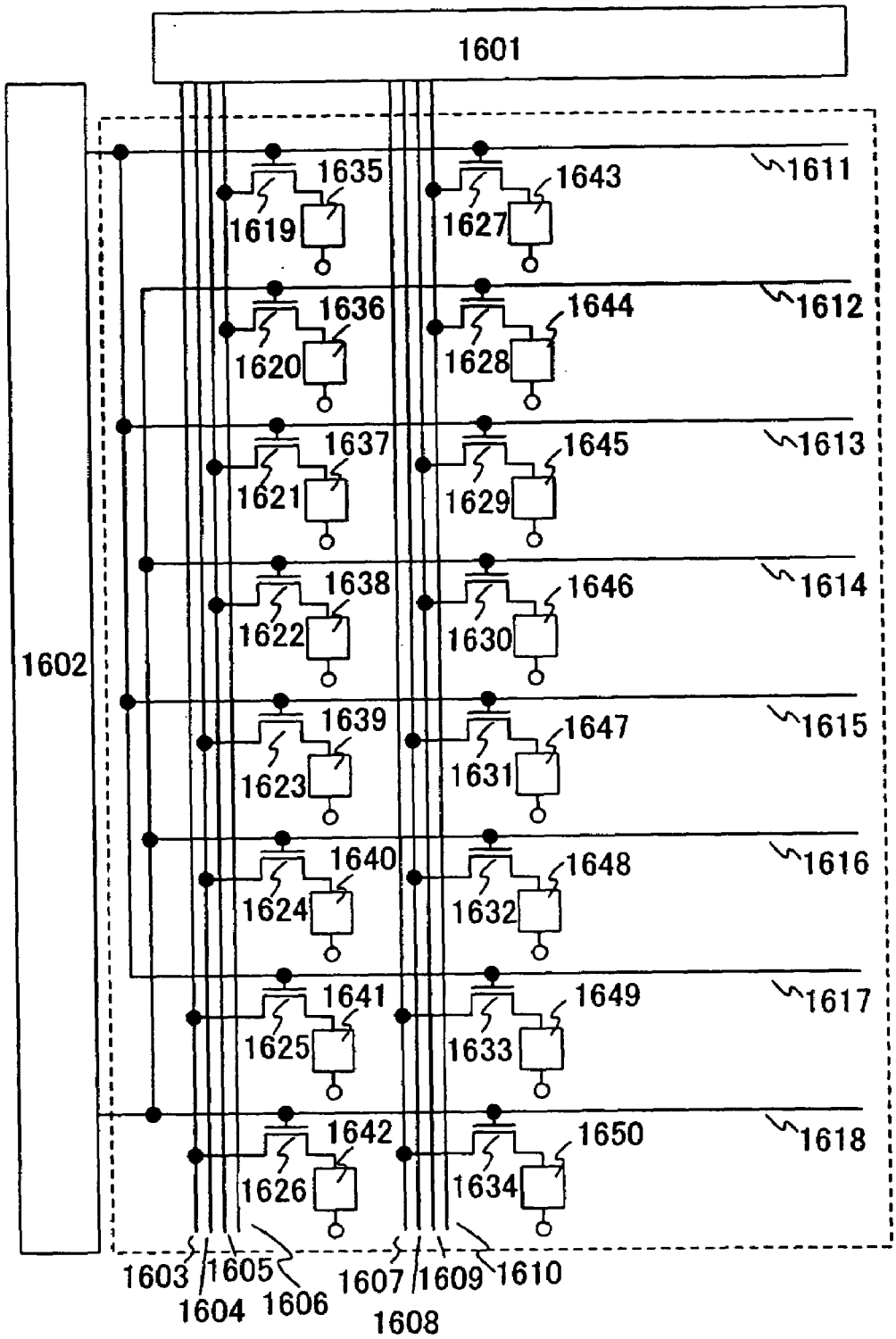
FIG. 16 is a diagram showing an embodiment in which a gate signal line of the present invention is connected.

FIG. 16 shows an example in which the timing of a simultaneous driving of gate signal lines is different from that in the aforementioned Embodiment Mode, and Embodiments 1 and 2. In this embodiment, a gate signal line driver circuit 1602 and each gate signal line are connected in a different manner than the aforementioned Embodiment Mode and Embodiments.

When current is output from a source signal line driver circuit 1601 to source signal lines 1603 to 1610 and gate signal lines 1611, 1613, 1615, and 1617 become high (in the case where a pixel TFT is an N-channel type), current flows into TFTs 1619, 1621, 1623, 1625, 1627, 1629, 1631, and 1633, and through these TFTs, the current flows into EL elements 1635, 1637, 1639, 1641, 1643, 1645, 1647, and 1649, and a common cathode, so that the EL elements 1635, 1637, 1639, 1641, 1643, 1645, 1647, and 1649 emit light.

Subsequently, when the gate signal lines 1611, 1613, 1615, and 1617 become low (in the case where a pixel TFT is an N-channel type), the TFTs 1619, 1621, 1623, 1625, 1627, 1629, 1631, and 1633 are turned OFF. Then when gate signal lines 1612, 1614, 1616, and 1618 become high, TFTs 1620, 1622, 1624, 1626, 1628, 1630, 1632, and 1634 are turned ON and current flows into EL elements 1636, 1638, 1640, 1642, 1644, 1646, 1648, and 1650, so that they emit light. By repeating this, the whole screen emits light. Described above is the case where the pixel TFT is an N-channel type, however, a potential of the gate signal line is reversed to this in the case where the pixel TFT is a P-channel type.

The source signal line driver circuit 1601 and the gate signal line driver circuit 1602 may be formed together with the pixel TFT on the substrate, or alternatively, a driver circuit may be manufactured separately from the pixel TFT and mounted on a pixel substrate. Monocrystalline silicon or non-monocrystalline such as poly-silicon and amorphous silicon may be used for the driver circuit.

In the case of expressing a gray scale, the expression is achieved by controlling current flowing through a source signal line as shown in FIG. 4. The present invention is not limited to the above description, and the simultaneous driving by other combinations may be performed in the similar manner. It is also possible to set any gate signal lines to be driven simultaneously as desired.

Embodiment 4

Figure 7:
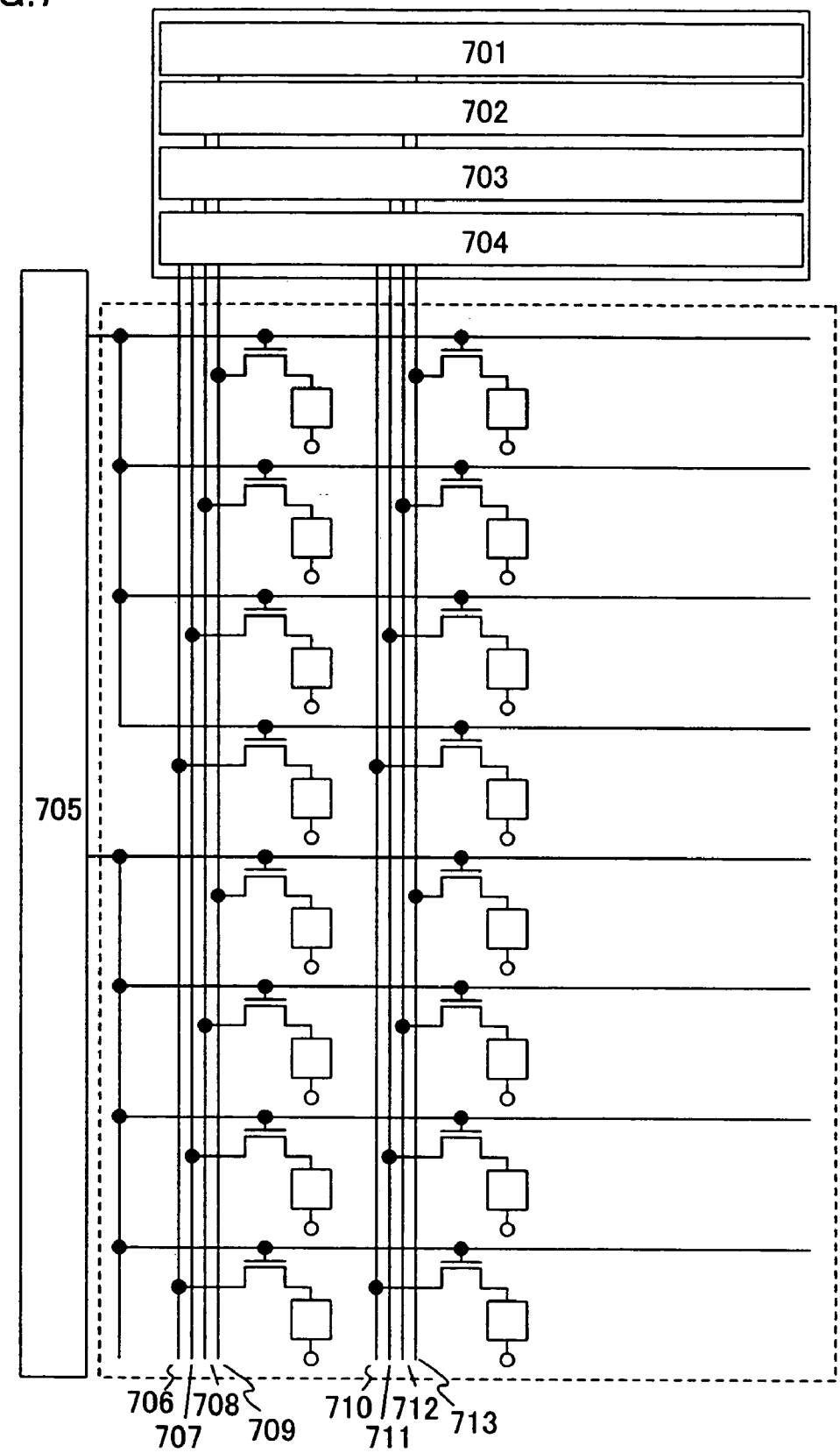
FIG. 7 is a diagram showing a pixel and a source signal line driver circuit of the present invention.
Figure 8:
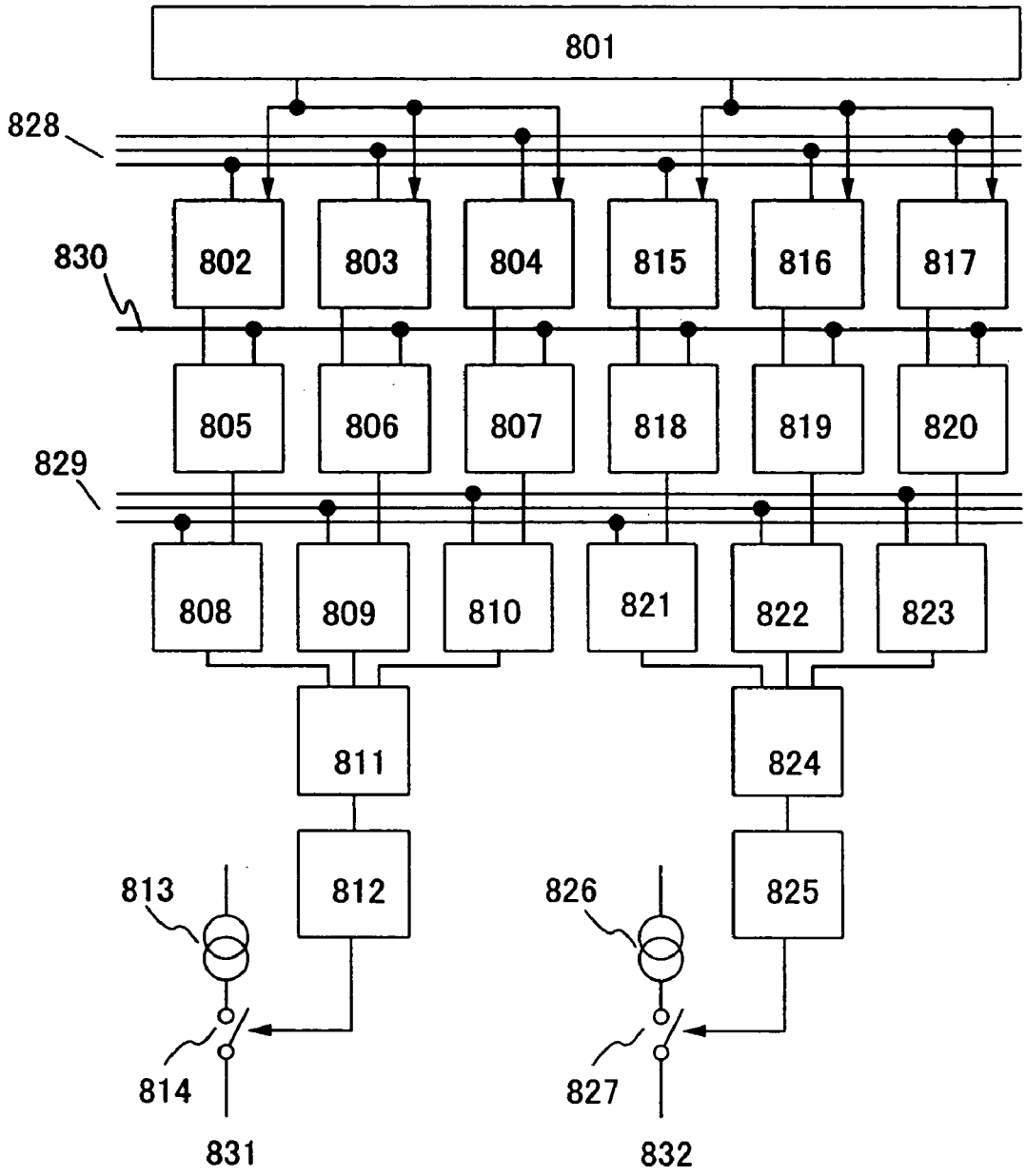
FIG. 8 is a block diagram showing a source signal line driver circuit of the present invention.

FIG. 7 shows a source signal line driver circuit of the present invention. For one pixel column, source signal line driver circuits 701 to 704 can be provided, which are connected to respective source signal lines in this embodiment as shown in FIG. 7. In FIG. 7, reference numerals 706 to 713 denote source signal lines and 705 denotes a gate signal line driver circuit. FIG. 8 shows a configuration of each source signal line driver circuit (for example 701). FIG. 8 corresponds to a driving as shown in FIG. 4. As FIG. 4 is an example of 3-bit, an embodiment shown in FIG. 8 also corresponds to 3-bit, however, it is not limited to 3-bit. Operation thereof is described hereinafter.

First, a digital image signal which is input to image signal lines 828 is stored in latch circuits 802 to 804 and 815 to 817 by an output pulse of a shift register 801. When data of one line is stored, a latch signal line 830 becomes high in a horizontal flyback period and the data is transferred to latch circuits 805 to 807 and 818 to 820. In the subsequent image period, a digital image signal is again stored in the latch circuits 802 to 804 and 815 to 817.

Meanwhile, data accumulated in the latch circuits 805 to 807 and 818 to 820 and data input from count signal lines 829 are compared by EXNORs 808 to 810 and 821 to 823. An output of the EXNORs is input to ANDs 811 and 824. When each of the data becomes high, the states of latch circuits 812 and 825 are changed. Switches 814 and 827 are opened or closed corresponding to this state change to control the current supply or non-supply from constant current sources 813 and 826 to source signal lines 831 and 832.

Signals from 000 to 111 are output to the count signal lines in sequence. Assuming that each data of the latch circuits 805 to 807 is 1, 0, and 1 respectively, the latch circuit 812 operates to close the switch when a count signal is 101. Thus, current flows into the source signal line and the lighting is performed during a period in which the count signal takes from 000 to 101. In this manner, the period in which current flows into a source signal line is controlled based on a data of a digital image signal, so that a gray scale can be expressed.

The source signal line driver circuit shown in this embodiment can be applied to other embodiments in this description.

Embodiment 5

Figure 9:
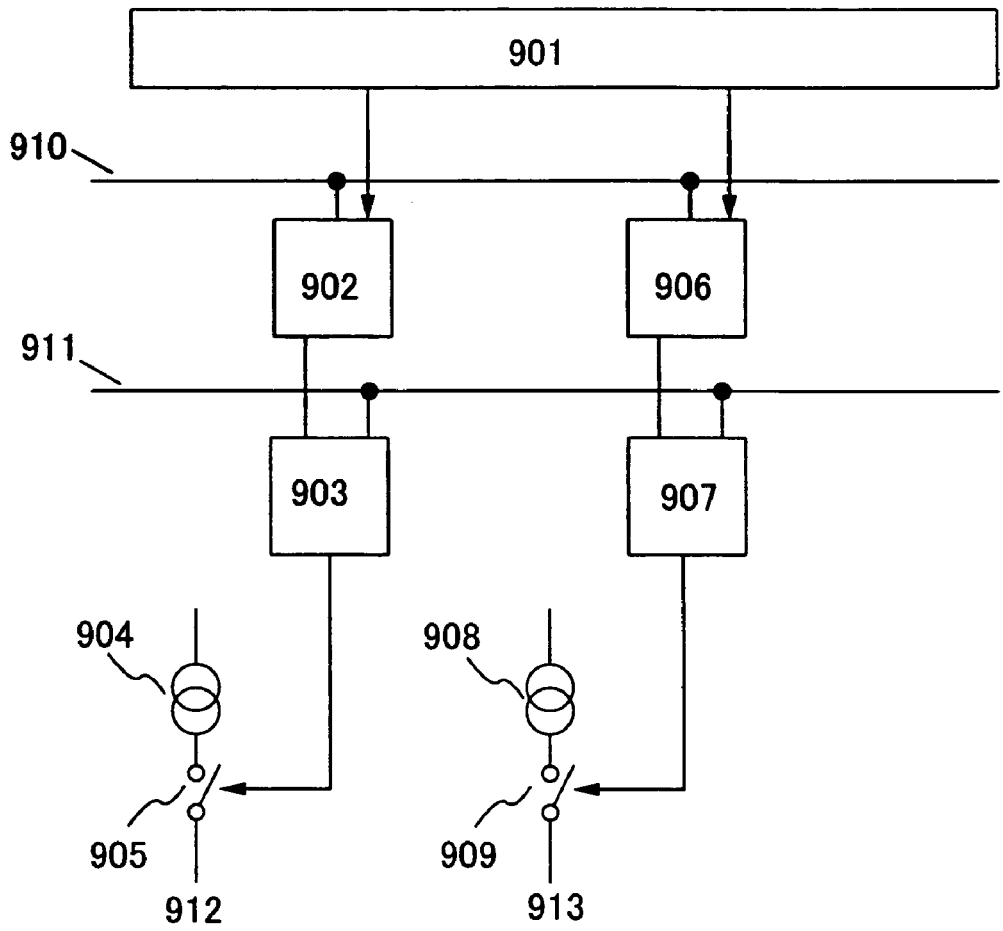
FIG. 9 is a block diagram showing a source signal line driver circuit of the present invention.

FIG. 9 is an embodiment of a source signal line driver circuit in the case where a gray scale is expressed by turning ON/OFF per bit. In such a case, the source signal line driver circuit can be simplified since only specified bit data is input as an image signal. Operation thereof is described hereinafter. A digital image signal which is input to an image signal line 910 is stored in latch circuits 902 and 906 by an output pulse of a shift register 901. Then, when a latch signal line 911 becomes high, the signal is transferred to latch circuits 903 and 907. Then, the subsequent digital image signal is stored in the latch circuits 902 and 906. Switches 905 and 909 are controlled by the output of the latch circuits 903 and 907 to determine whether to flow current of constant current sources 904 and 908 to source signal lines 912 and 913 or not. In this manner, a pixel can emit light.

Embodiment 6

Figure 3:
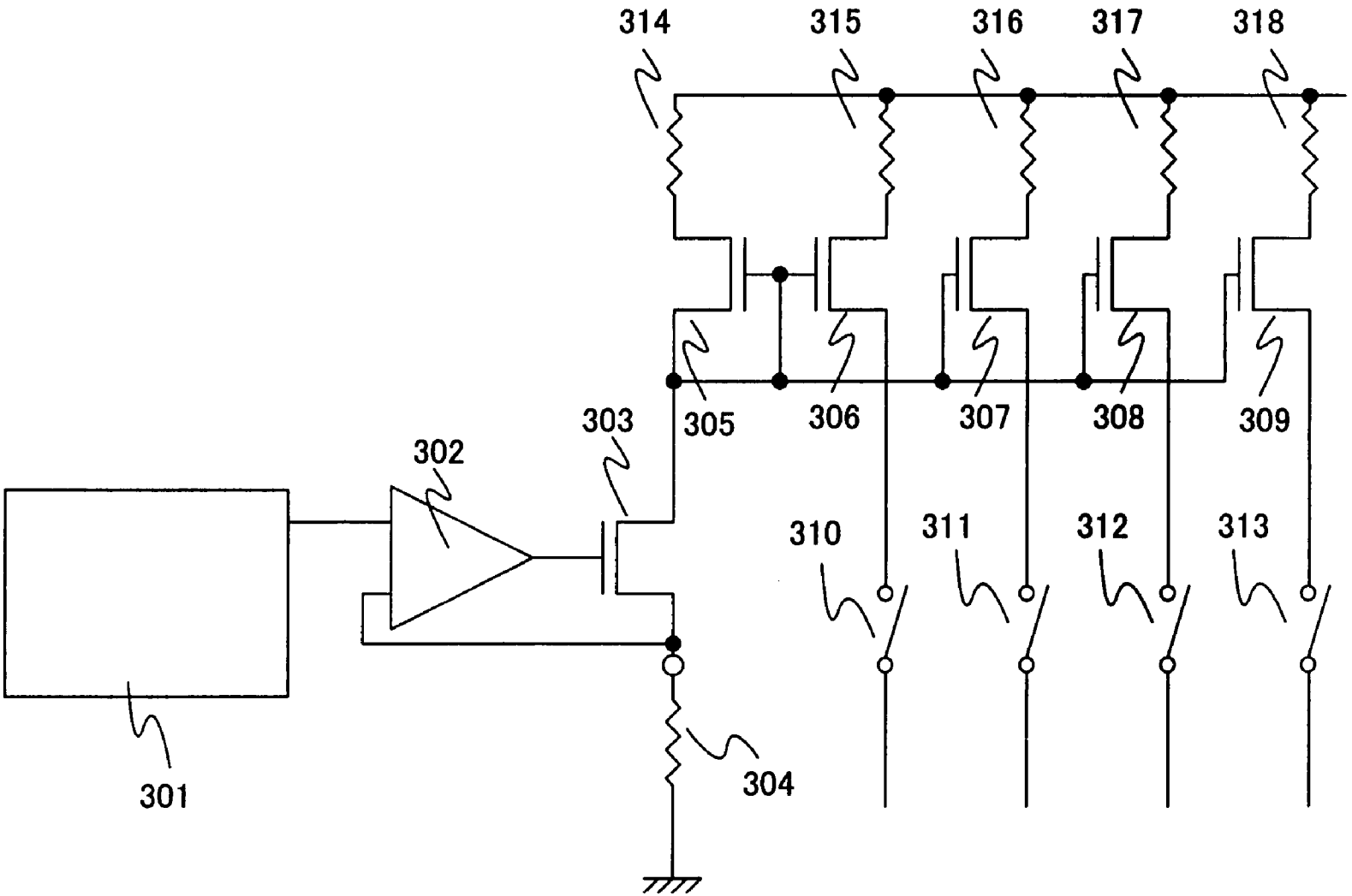
FIG. 3 is a diagram showing a conventional current source circuit.
Figure 10:
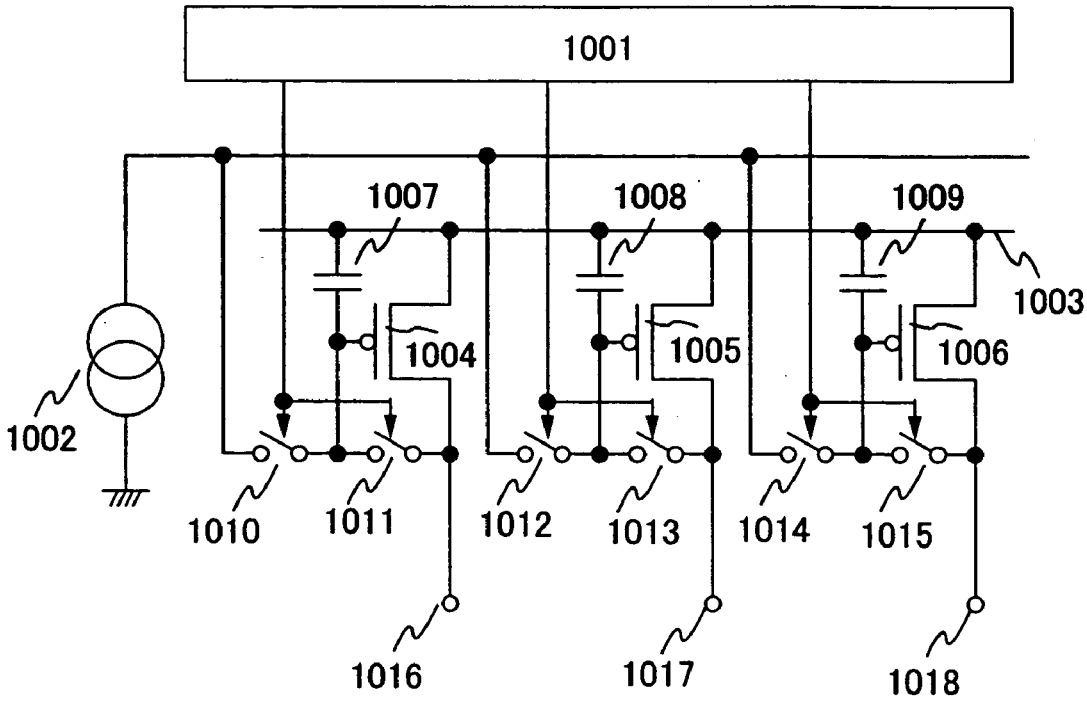
FIG. 10 is a block diagram showing a constant current source of the present invention.

FIG. 10 shows an embodiment of a constant current source. FIG. 3 shows an example of a conventional constant current source in which a number of current mirror circuits are used, so that errors are likely to occur. Therefore, FIG. 10 shows the one with a countermeasure against it. FIG. 10 is a constant current circuit wherein a reference current source 1002 is provided outside or inside of a source signal line driver circuit, and current of the reference current source 1002 flows into TFTs 1004 to 1006 in sequence and gate-source voltages of the TFTs 1004 to 1006 at that time are stored in storage capacitors 1007 to 1009 respectively so that the same amount of current of the constant current source 1002 flows into output terminals 1016 to 1018.

Operation thereof is described hereinafter. A shift register 1001 shifts an output pulse in sequence. Firstly, when a shift pulse is applied to switches 1010 and 1011 to be turned ON, current flows from a power source line 1003 into the constant current source 1002 through the TFT 1004, the switches 1011 and 1010. When the output pulse of the shift register is applied to switches 1012 and 1013, current flows from the power source line 1003 into the constant current source 1002 through the TFT 1005, the switches 1013 and 1012. At this time, the switches 1010 and 1011 are already OFF, however, charge is held in the capacitor 1007, so that the TFT 1004 is kept ON and current flows from the power source line 1003 into the output terminal 1016.

When the output pulse of the shift register is applied to switches 1014 and 1015, current flows from the power source line 1003 into the constant current source 1002 through the TFT 1006, the switches 1015 and 1014. At this time, the switches 1010, 1011, 1012, and 1013 are already OFF, however, charge is held in the capacitors 1007 and 1008, so that the TFTs 1004 and 1005 are kept ON and current flows from the power source line 1003 into the output terminals 1016 and 1017. A current source by which a source signal line is driven based on the reference constant current source 1002 can be configured in this manner. This current source is not affected by variations of elements of the TFTs 1004 to 1006 in principle if charge accumulated in the capacitor can be held. Therefore, a current source with few variations can be configured.

Embodiment 7

Figure 11:
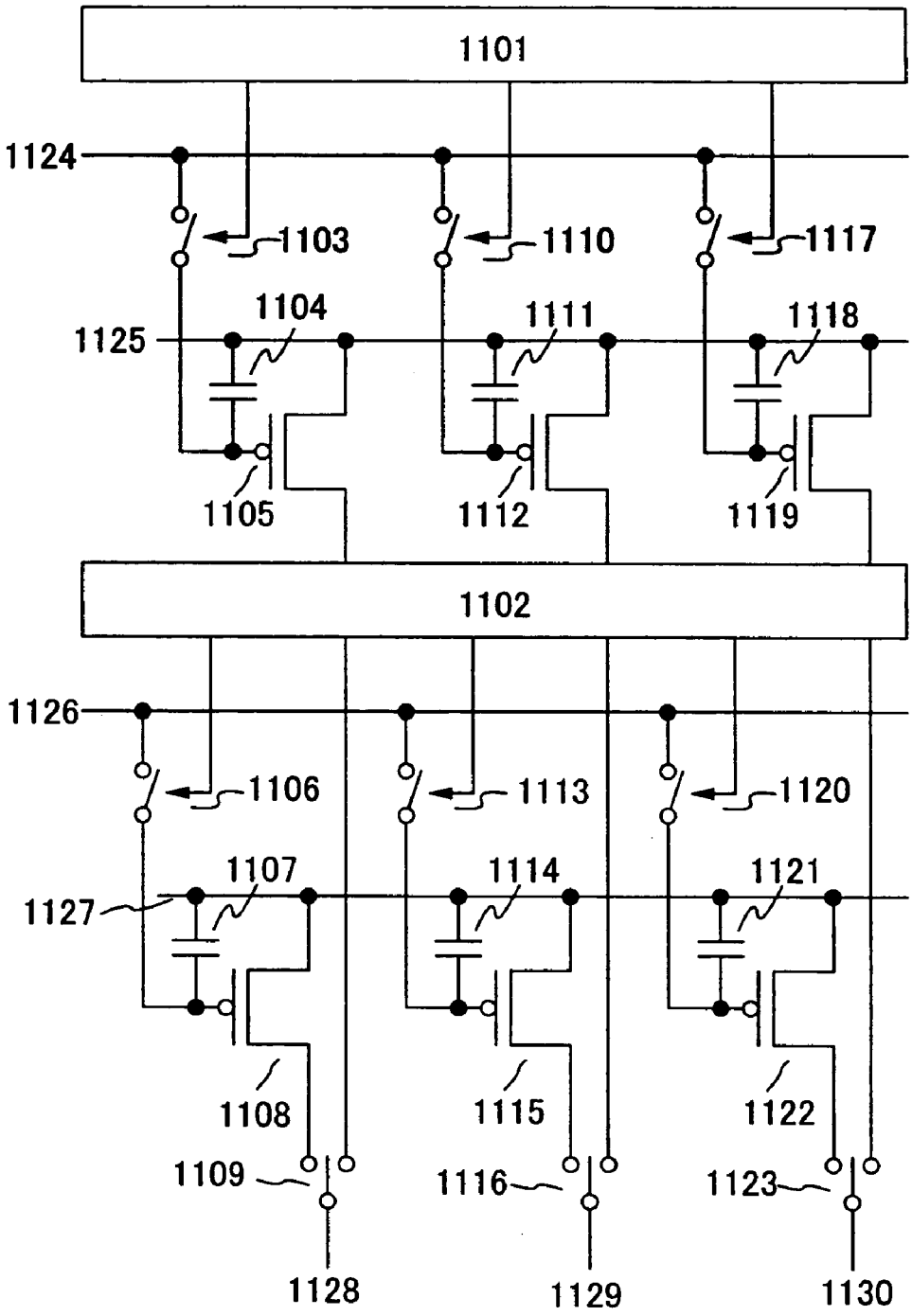
FIG. 11 is a diagram showing a source signal line driver circuit of the present invention using an analog image signal.

FIG. 11 shows an embodiment of a source signal line driver circuit of the present invention. FIG. 11 is a source signal line driver circuit in which an analog image signal (voltage) is input and the amount of current according to the voltage is output to a source signal line.

Firstly, an analog image signal for the first row is input to an analog image signal line 1124. ON/OFF of switches 1103, 1110, and 1117 is controlled by an output pulse of a shift register 1101 to sample and hold the analog image signal in capacitors 1104, 1111, and 1118. The voltage serves as respective gate-source voltage of TFTs 1105, 1112, and 1119. Until the sampling of the first row is completed, the switches 1109, 1116, and 1123 connect TFTs 1108, 1115, and 1122 to source signal lines 1128, 1129, and 1130 respectively, and do not connect the TFTs 1105, 1112, and 1119 to the source signal lines. Therefore, even if a voltage is applied between each gate and source of the TFTs 1105, 1112, and 1119, no current flows. After the sampling is completed, the switches 1109, 1116, and 1123 are switched to connect the TFTs 1105, 1112, and 1119 to the source signal lines. The amount of current according to the analog image signal is output to the source signal line in this manner.

Next, an analog image signal for the second row is input to an analog image signal line 1126. ON/OFF of switches 1106, 1113, and 1120 is controlled by an output pulse of a shift register 1102 to sample and hold the analog image signal in capacitors 1107, 1114, and 1121. The voltage serves as respective gate-source voltage of TFTs 1108, 1115, and 1122. Until the sampling of the second row is completed, the switches 1109, 1116, and 1123 connect TFTs 1105, 1112, and 1119 to the respective source signal lines, and do not connect the TFTs 1108, 1115, and 1122 to the source signal lines. Therefore, even if a voltage is applied between each gate and source of the TFTs 1108, 1115, and 1122, no current flows. After the sampling is completed, the switches 1109, 1116, and 1123 are switched to connect the TFTs 1108, 1115, and 1122 to the source signal lines. The amount of current according to the analog image signal is output to the source signal line in this manner.

Subsequently, an analog image signal for the third row is input to the analog image signal line 1124. The analog image signal is sampled by an output pulse of the shift register 1101. The amount of current according to the analog image signal is output to the source signal line by repeating such operations.

In FIG. 11, reference numerals 1125 and 1127 denote power source lines.

Embodiment 8

Figure 12:
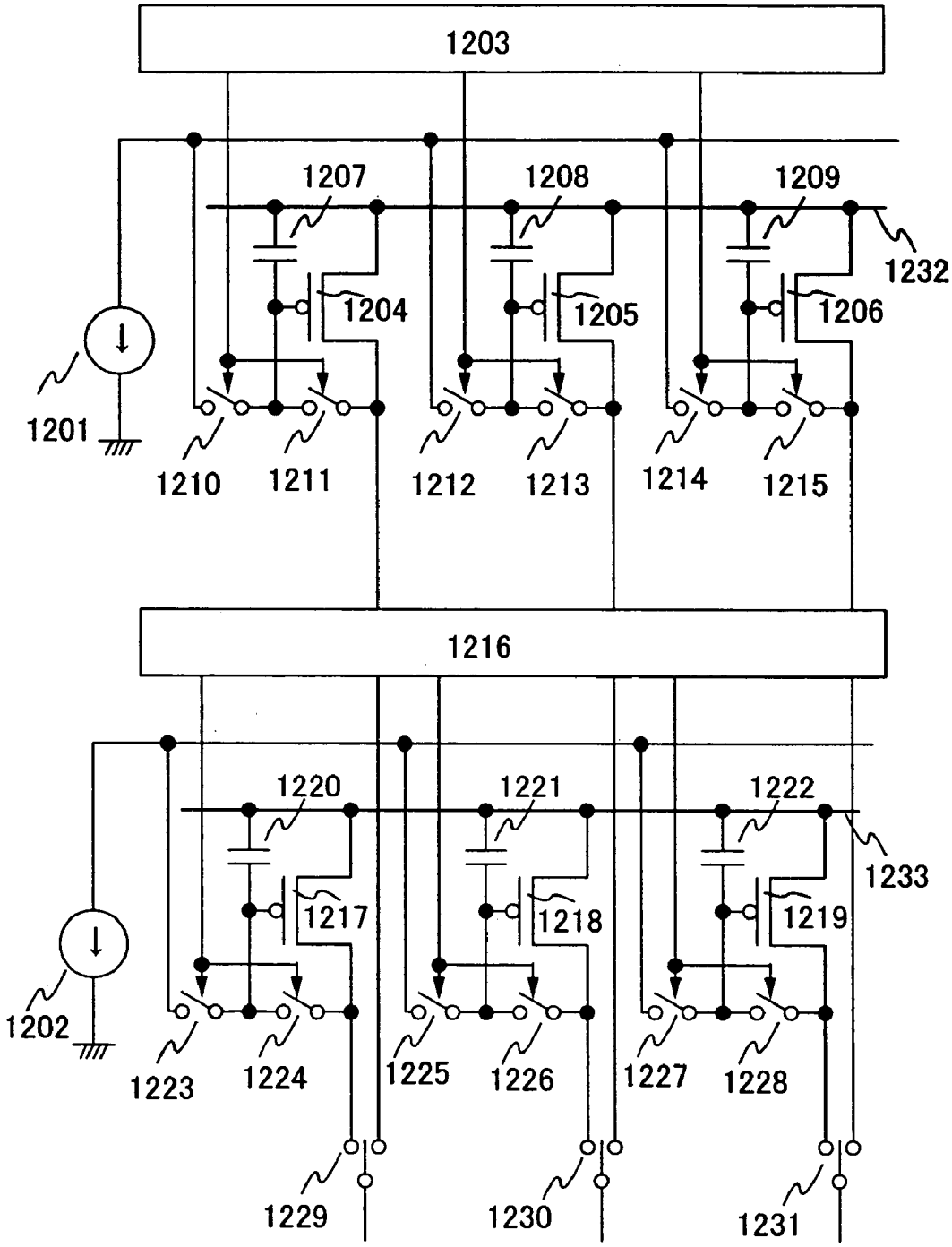
FIG. 12 is a diagram showing a source signal line driver circuit of the present invention using an analog image signal.

FIG. 12 shows an embodiment of a source signal line driver circuit of the present invention. FIG. 12 is a source signal line driver circuit in which an analog image signal (current) is input and the amount of current according to the current is output to a source signal line.

Firstly, an analog image signal for the first row is input from an analog current source 1201. ON/OFF of switches 1210 to 1215 is controlled by an output pulse of a shift register 1203 to sample the analog current image signal and generate respective gate-source voltage of TFTs 1204 to 1206. Then, they are held in capacitors 1207 to 1209. Until the sampling of the first row is completed, switches 1229 to 1231 connect TFTs 1217 to 1219 to respective source signal lines, and do not connect the TFTs 1204 to 1206 to the source lines. Therefore, even if a voltage is applied between each gate and source of the TFTs 1204 to 1206, no current flows. After the sampling is completed, the switches 1229 to 1231 are switched to connect the TFTs 1204 to 1206 to the source signal lines. The amount of current according to the analog image signal is output to the source signal line in this manner.

Next, an analog image signal for the second row is input from an analog current source 1202. ON/OFF of switches 1223 to 1228 is controlled by an output pulse of a shift register 1216 to sample the analog current image signal and generate respective gate-source voltage of the TFTs 1217 to 1219. Then, they are held in capacitors 1220 to 1222. Until the sampling of the second row is completed, the switches 1229 to 1231 connect the TFTs 1204 to 1206 to respective source signal lines, and do not connect the TFTs 1217 to 1219 to the source lines. Therefore, even if a voltage is applied between each gate and source of the TFTs 1217 to 1219, no current flows. After the sampling is completed, the switches 1229 to 1231 are switched to connect the TFTs 1217 to 1219 to the source signal lines. The amount of current according to the analog image signal is output to the source signal line in this manner.

Subsequently, an analog image signal for the third row is input from the analog current source 1201. An analog current image signal is sampled by an output pulse of the shift register 1203. The amount of current according to the analog image signal is output to the source signal line by repeating such operations.

Embodiment 9

Figure 15:
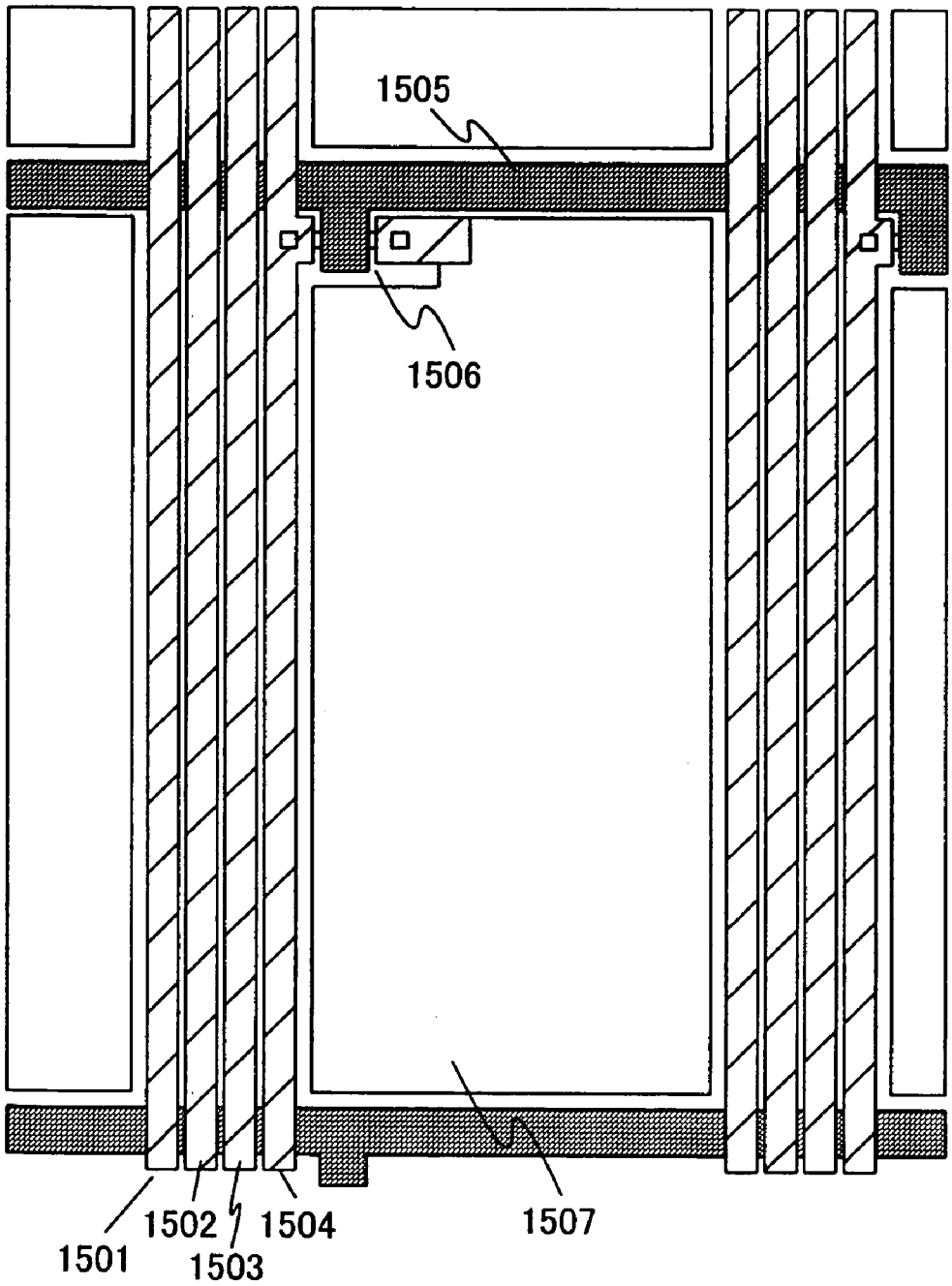
FIG. 15 is a plan view of a pixel of the present invention.

FIG. 15 shows a plan view of a pixel of the present invention. This example provides four source signal lines 1501 to 1504 and a source signal line 1504 is connected to either one of a source electrode or a drain electrode of a pixel TFT 1506. The other electrode of the pixel TFT which is not connected to the source signal line 1504, the source electrode or the drain electrode, is connected to a pixel electrode 1507. The pixel electrode 1507 corresponds to an anode or a cathode of an EL element. A gate signal line 1505 is connected to a gate of the TFT 1506.

The number of source signal lines of the present invention is larger than that of a conventional active matrix EL light-emitting device, while the source signal line can be interposed in a boundary portion of each color in the case where a pixel is colorized by applying selectively. In addition, since only one TFT is required in one pixel and no storage capacitor is required, the opening ratio can be increased.

Furthermore, in the case where of a top emission type in which a counter electrode different from a pixel electrode of an EL element is a transparent electrode and light from the EL element is emitted to the top side, an insulating film can be formed on a source signal line and a pixel electrode can be disposed thereon. In this case, the pixel electrode can occupy ninety percent or more of a pixel.

Embodiment 10

According to the present invention, a pixel TFT serves only as a switch, therefore the pixel TFT does not need to be a transistor with high performance. An amorphous TFT, an organic TFT, and the like may be employed as the pixel TFT. A source signal line driver circuit and a gate signal line driver circuit can not be integrated in this case, thus they are configured by a monocrystalline transistor or a polycrystalline transistor and mounted on a pixel TFT substrate for driving.

In the case of a large display device, most of its cost is not for driving circuits such as a source signal line driver circuit and a gate signal line driver circuit but for a pixel portion. Consequently, large cost reduction can be realized by employing an amorphous TFT and the like, not a polysilicon TFT.

This embodiment can be used in combination with the aforementioned other embodiments.

Embodiment 11

Figure 17:
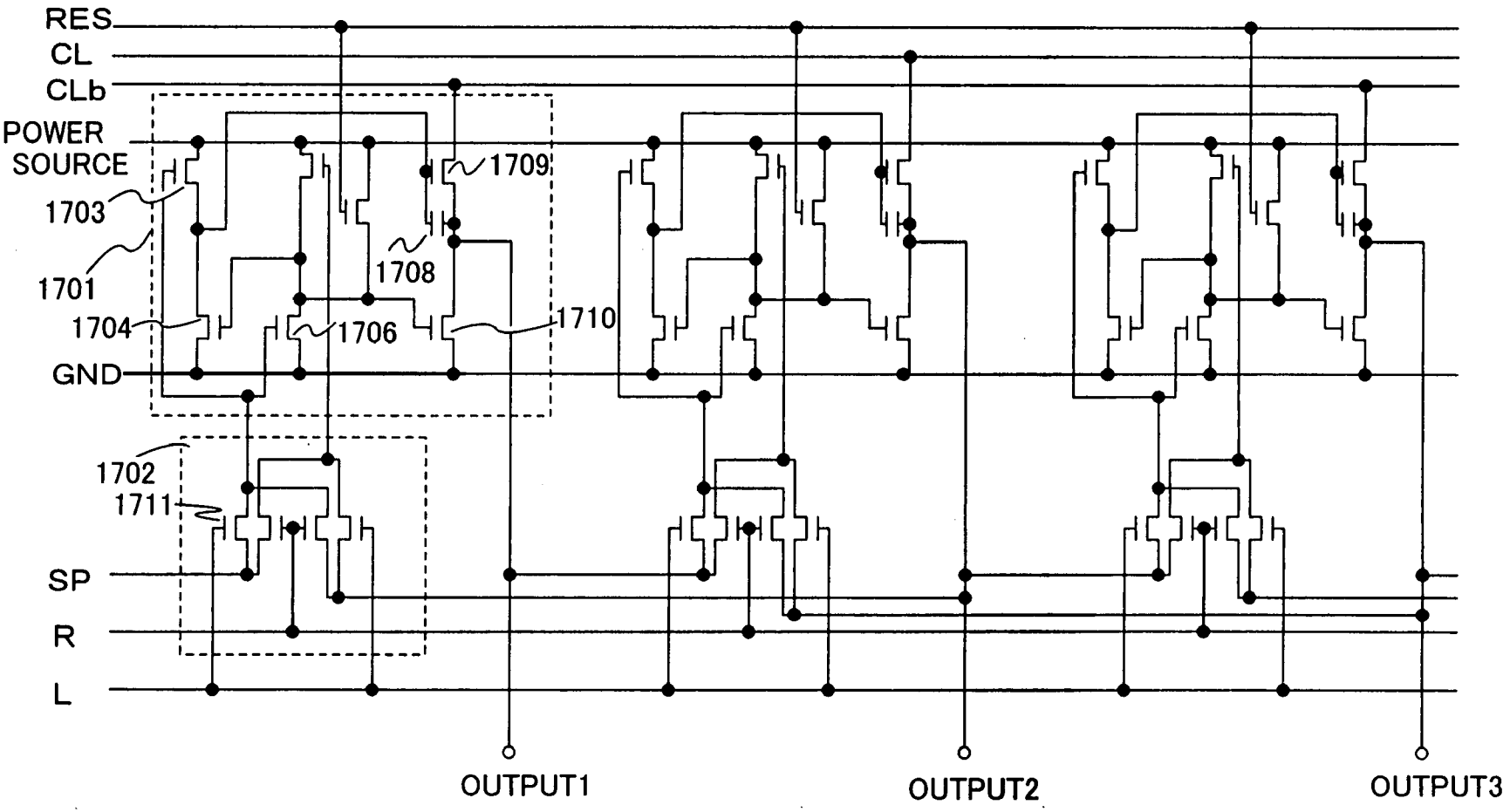
FIG. 17 is an embodiment of a signal line driver circuit of the present invention using TFTs having single polarity.

FIG. 17 is an example of a shift register which is configured by using a TFT having single polarity. FIG. 17 is a case of using an N-channel type, however, either an N-channel type or a P-channel type may be used as single polarity. By using either one or both of a source signal line driver circuit and a gate signal line driver circuit manufactured by the process of a single polarity transistor, the number of masks needed for manufacturing a display device can be reduced.

In FIG. 17, a start pulse SP is input to a shift register 1701 through a switching TFT 1711 after being input to a scanning direction changing switch 1702. The shift register is a set reset type shift register which uses bootstrap. Operation of the shift register 1701 is described hereinafter.

The start pulse is input to a gate of a TFT 1703 and a gate of a TFT 1706. When the TFT 1706 is turned ON, a gate of a TFT 1704 becomes low and the TFT 1704 is turned OFF. In addition, since a gate of a TFT 1710 also becomes low, the TFT 1710 is turned OFF. The gate potential of the TFT 1703 is raised to the level of the power source potential. Therefore, the gate potential of the TFT 1709 is first raised to the level of 'power source—Vgs'. Since the initial potential of an output 1 is Lo, the TFT 1709 raises a source potential while charging the output 1 and a capacitor 1708. When the gate of the TFT 1709 reaches the 'power source—Vgs', the TFT 1709 is still ON. Therefore, the output 1 continues its rise in potential. The gate of the TFT 1709 has no discharge path and therefore continues to rise in potential corresponding to the source thereof even past the power source potential.

When a drain and the source of the TFT 1709 reach the same potential, the current flows to the output is stopped and the rise in potential of the TFT 1709 is stopped. The output 1 can output high potential equal to the power source potential in this manner. At this point, the potential of a CLb is set high. When the CLb drops to low, charges in the capacitor 1708 are sent to the CLb through the TFT 1709 and the output 1 drops to Lo. Pulses of the output 1 are transferred to the shift register of the next stage. This embodiment can be used in combination with other embodiments in this description.

Embodiment 12

Figure 19:
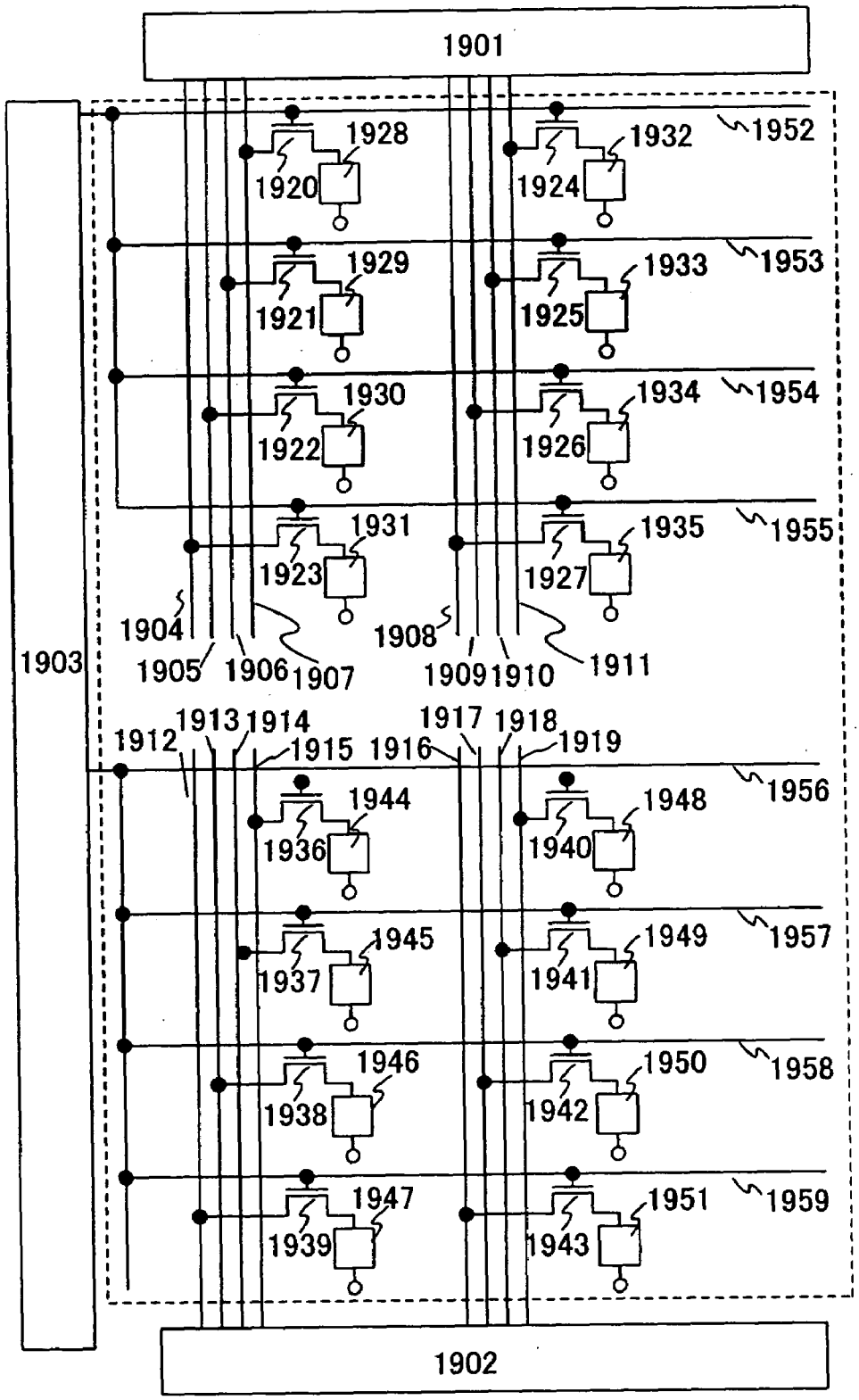
FIG. 19 is a diagram showing an embodiment in which a signal line driver circuit of the present invention is disposed on both sides of a pixel portion.

FIG. 19 shows an embodiment in which source signal line driver circuits are disposed on both sides of a pixel portion. In the case where this arrangement is employed and the source signal line driver circuits on both sides are driven simultaneously, eight rows of pixels can be lighted simultaneously as an example of FIG. 19 and a longer light emission time of an EL element can be realized. Operation is described hereinafter.

When current is output from a source signal line driver circuit 1901 to source signal lines 1904 to 1911 and gate signal lines 1952 to 1955 become high (in the case where a pixel TFT is an N-channel type), current flows into TFTs 1920 to 1927, and through the TFTs, the current flows into EL elements 1928 to 1935 and a common cathode, so that the EL elements 1928 to 1935 emit light.

Simultaneously with the above operation, when current is output from a source signal line driver circuit 1902 to source signal lines 1912 to 1919 and gate signal lines 1956 to 1959 become high (in the case where a pixel TFT is an N-channel type), current flows into TFTs 1936 to 1943, and through the TFTs, the current flows into EL elements 1944 to 1951 and a common cathode, so that the EL elements 1944 to 1951 emit light.

The source signal line driver circuits 1901, 1902, and a gate signal line driver circuit 1903 may be formed together with a pixel TFT on the substrate, or alternatively, a driver circuit may be manufactured separately from the pixel TFT and mounted on a pixel substrate. Monocrystalline silicon or non-monocrystalline such as poly-silicon and amorphous silicon may be used for the driver circuit.

In the case of expressing a gray scale, the expression is achieved by controlling current flowing through a source signal line as shown in FIG. 4.

Embodiment 13

A display device manufactured as described above can be used in a display portion of various types of electronic apparatuses. Hereinafter, electronic apparatuses in which the display device manufactured according to the present invention is incorporated as a display medium are described.

Figure 18:
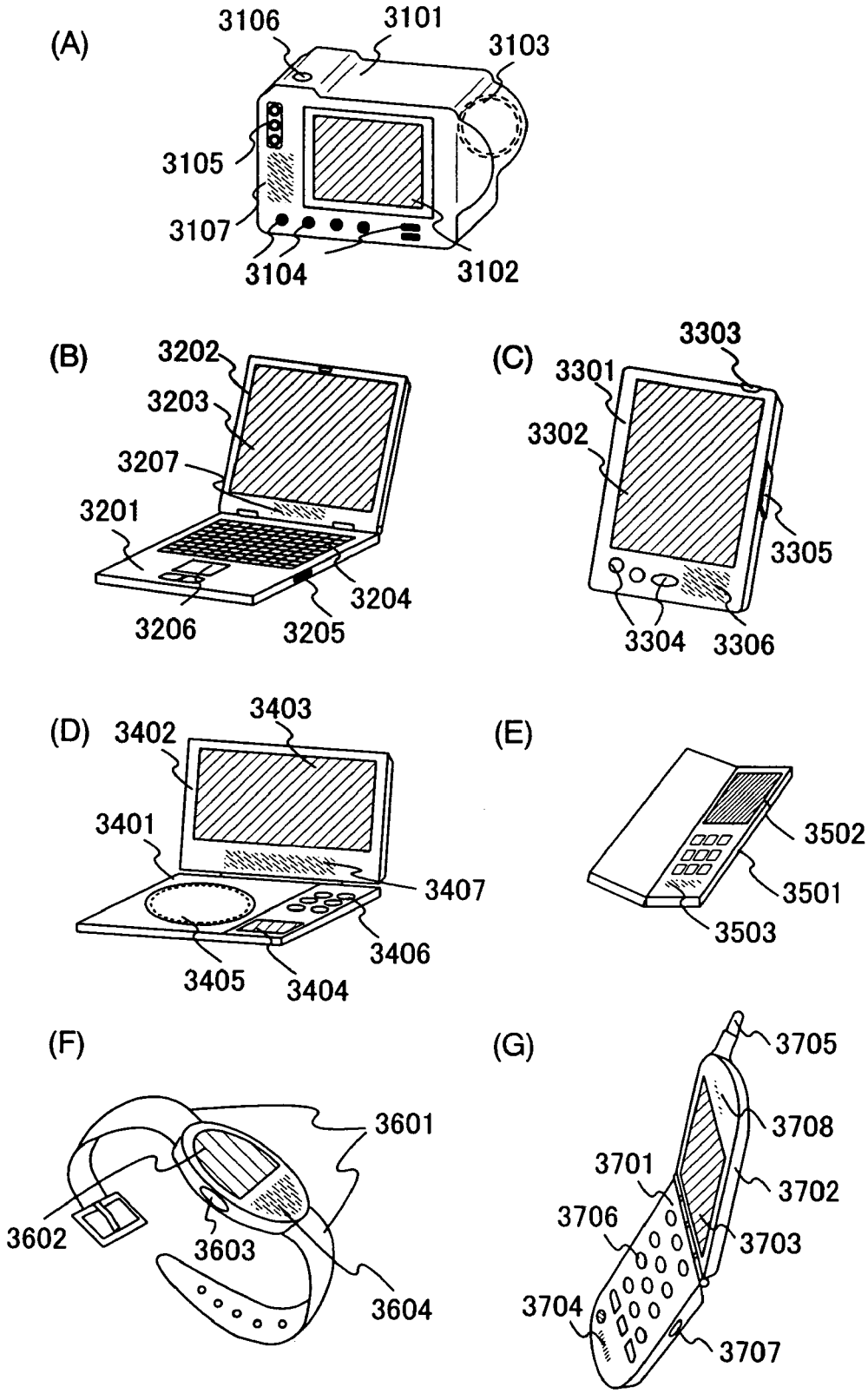
FIG. 18 is a view of electronic apparatuses each using a display device of the present invention.

Such electronic apparatuses are as follows: video cameras, digital cameras, head mounted displays (goggle type displays), game machines, car navigation systems, personal computers, portable information terminals, mobile phones, electronic books, etc. Examples thereof are shown in FIG. 18.

FIG. 18(A) is a digital camera which includes a body 3101, a display portion 3102, an image receiving portion 3103, operation keys 3104, an external connecting port 3105, a shutter 3106, and an audio output portion 3107. A display device of the present invention can be used in the display portion 3102 of the camera.

FIG. 18(B) is a notebook computer which includes a body 3201, a housing 3202, a display portion 3203, a keyboard 3204, an external connecting port 3205, a pointing mouse 3206, and an audio output portion 3207. A display device of the present invention can be used in the display portion 3203.

FIG. 18(C) is a portable information terminal which includes a body 3301, a display portion 3302, a switch 3303, operation keys 3304, an infrared port 3305, and an audio output portion 3306. A display device of the present invention can be used in the display portion 3302.

FIG. 18(D) is an image reproducing device provided with a recording medium (specifically, DVD reproducing device) which includes a body 3401, a housing 3402, a recording medium (such as a CD, an LD and a DVD) read-in portion 3405, an operation switch 3406, an audio output portion 3407, a display portion (a) 3403, a display portion (b) 3404, and the like. The display portion (a) mainly displays image information and the display portion (b) mainly displays character information. A display device of the present invention can be used in the display portion (a) and in the display portion (b) of the image reproducing device having the recording medium. Note that CD reproducing devices, game machines and the like are included in the image reproducing device provided with a recording medium in which the present invention can be used.

FIG. 18(E) is a folding portable display device, and a display portion 3502 in which the present invention is used can be mounted on a body 3501. Reference numeral 3503 denotes an audio output portion.

FIG. 18(F) is a wristwatch type display device which includes a belt 3601, a display portion 3602, an operation switch 3603, and an audio output portion 3604. A display device of the present invention can be used in the display portion 3602.

FIG. 18(G) is a mobile phone which includes a body 3701, a housing 3702, a display portion 3703, an audio input portion 3704, an antenna 3705, an operation key 3706, an external connecting port 3707, and an audio output portion 3708. A display device of the present invention can be used in the display portion 3703.

As described above, the applicable range of the present invention is so wide that the invention can be applied to electronic apparatuses of various fields. Note that the electronic apparatuses of this embodiment can be achieved by utilizing any combination of configurations in Embodiments 1 to 12.

The invention claimed is:

1. A driving method of a display device comprising the steps of:

supplying current from a constant current source in a source signal line driver circuit to one of a plurality of source signal lines;

turning switching elements ON by driving a plurality of gate signal lines simultaneously;

inputting the current of one of the plurality of source signal lines to a light-emitting element; and driving the light-emitting element, wherein the plurality of source signal lines are disposed for one pixel column, wherein each of the switching elements has an input terminal, an output terminal, and a control terminal, wherein the input terminal is electrically connected to one of the plurality of source signal lines, wherein the output terminal is electrically connected to the light-emitting element, and wherein the control terminal is electrically connected to one of the plurality of the gate signal lines.

2. The driving method of the display device according to claim 1, wherein each of the switching elements comprises one thin film transistor.

3. The driving method of the display device according to claim 1, wherein each of the switching elements comprises a multi-gate thin film transistor.

4. The driving method of the display device according to claim 1, wherein the light-emitting element is an EL element.

5. A display device comprising:

a plurality of pixels, each of the plurality of pixels comprising:

a switching element, a light-emitting element, a plurality of source signal lines, one gate signal line, and a source signal line driver circuit comprising a constant current source, wherein the constant current source is electrically connected to one of the plurality of source signal lines, wherein the switching element has an input terminal, an output terminal, and a control terminal, wherein the input terminal is electrically connected to any one of the plurality of source signal lines, wherein the output terminal is electrically connected to the light-emitting element, and wherein the control terminal is electrically connected to the gate signal line.

6. The display device according to claim 5, wherein the switching element comprises one thin film transistor.

7. The display device according to claim 5, wherein the switching element comprises a multi-gate thin film translator.

8. The display device according to claim 5, wherein the light-emitting element is an EL element.

9. An electronic apparatus equipped with the display device according to claim 5, wherein the electronic apparatus is one selected from the group consisting of a video camera, a digital camera, a notebook personal computer, a mobile computer, a portable image reproducing device provided with a recording medium, a head mounted display, a game machine, a car navigation system, a personal computer, a portable information terminal, a mobile phone, an electronic book, a folding portable display device, and a wristwatch type display device.

10. The display device according to claim 5, wherein the source signal line driver circuit is a current output type source signal line driver circuit.

11. The display device according to claim 5, wherein the source signal line driver circuit is formed using a thin film transistor.

12. The display device according to claim 5, wherein the source signal line driver circuit is formed over the same substrate as the switching element.

13. The display device according to claim 5, wherein the source signal line driver circuit is mounted over a semiconductor chip.

14. The display device according to claim 5, wherein the source signal line driver circuit is disposed on a side of a region where the plurality of pixels are disposed.

15. The display device according to claim 5, wherein the source signal line driver circuit drives any one of the plurality of source signal lines.

16. The display device according to claim 5, wherein the source signal line driver circuit is formed using transistors having a single polarity.

17. A display device comprising:

a plurality of pixels, each of the plurality of pixels comprising:

a switching element, a light-emitting element, a plurality of source signal lines, one gate signal line, and a plurality of source signal line driver circuits, each of the plurality of source signal line driver circuits comprising a constant current source, wherein the constant current source is electrically connected to at least one of the plurality of source signal lines, wherein the switching element has an input terminal, an output terminal, and a control terminal, wherein the input terminal is electrically connected to any one of the plurality of source signal lines, wherein the output terminal is electrically connected to the light-emitting element, and wherein the control terminal is electrically connected to the gate signal line.

18. The display device according to claim 17, wherein each of the plurality of source signal line driver circuits is a current output type source signal line driver circuit.

19. The display device according to claim 17, wherein each of the plurality of source signal line driver circuits is formed using a thin film transistor.

20. The display device according to claim 17, wherein each of the plurality of source signal line driver circuits is formed over the same substrate as the switching element.

21. The display device according to claim 17, wherein each of the plurality of source signal line driver circuits is mounted over a semiconductor chip.

22. The display device according to claim 17, wherein each of the plurality of the source signal line driver circuits is disposed on a side of a region where the plurality of pixels are disposed.

23. The display device according to claim 17, wherein at least one of the plurality of source signal line driver circuits drives any one of the plurality of source signal lines.

24. The display device according to claim 17, wherein each of the plurality of source signal line driver circuits is formed using transistors having a single polarity.

25. The display device according to claim 17, wherein the switching element comprises one thin film transistor.

26. The display device according to claim 17, wherein the switching element comprises a multi-gate thin film transistor.

27. The display device according to claim 17, wherein the light-emitting element is an EL element.

28. An electronic apparatus equipped with the display device according to claim 17, wherein the electronic apparatus is one selected from the group consisting of a video camera, a digital camera, a notebook personal computer, a mobile computer, a portable image reproducing device provided with a recording medium, a head mounted display, a game machine, a car navigation system, a personal computer, a portable information terminal, a mobile phone, an electronic book, a folding portable display device, and a wristwatch type display device.

29. A display device comprising:

a plurality of pixels, each of the plurality of pixels comprising:

a switching element, a light-emitting element, a plurality of source signal lines, a gate signal line, a gate signal line driver circuit connected to the gate signal line, and a source signal line driver circuit comprising a constant current source, wherein the constant current source is electrically connected to one of the plurality of source signal lines, wherein the switching element has an input terminal, an output terminal, and a control terminal, wherein the input terminal is electrically connected to any one of the plurality of source signal lines, wherein the output terminal is electrically connected to the light-emitting element, and wherein the control terminal is electrically connected to one-of the gate signal line.

30. The display device according to claim 29, wherein the gate signal line driver circuit is formed using a thin film transistor.

31. The display device according to claim 29, wherein the gate signal line driver circuit is formed over the same substrate as the switching element.

32. The display device according to claim 29, wherein the gate signal line driver circuit is mounted over a semiconductor chip.

33. The display device according to claim 29, wherein the gate signal line driver circuit is formed using transistors having a single polarity.

34. The display device according to claim 29, wherein the switching element comprises one thin film transistor.

35. The display device according to claim 29, wherein the switching element comprises, a multi-gate thin film transistor.

36. The display device according to claim 29, wherein the light-emitting element is an EL element.

37. An electronic apparatus equipped with the display device according to claim 29, wherein the electronic apparatus is one selected from the group consisting of a video camera, a digital camera, a notebook personal computer, a mobile computer, a portable image reproducing device provided with a recording medium, a head mounted display, a game machine, a car navigation system, a personal computer, a portable information terminal, a mobile phone, an electronic book, a folding portable display device, and a wristwatch type display device.

38. The display device according to claim 29, wherein the source signal line driver circuit is a current output type source signal line driver circuit.

39. The display device according to claim 29, wherein the source signal line driver circuit is formed using a thin film transistor.

40. The display device according to claim 29, wherein the source signal line driver circuits is formed over the same substrate as the switching element.

41. The display device according to claim 29, wherein the source signal line driver circuit is mounted over a semiconductor chip.

42. The display device according to claim 29, wherein the source signal line driver circuit is disposed on a side of a region where the plurality of pixels are disposed.

43. The display device according to claim 29, wherein the source signal line driver circuit drives any one of the plurality of source signal lines.

44. The display device according to claim 29, wherein the source signal line driver circuit is formed using transistors having a single polarity.

* * * * *